US009290000B2

(12) United States Patent
Takagiwa

(10) Patent No.: US 9,290,000 B2
(45) Date of Patent: Mar. 22, 2016

(54) CARTRIDGE CASE

(71) Applicant: BROTHER KOGYO KABUSHIKI KAISHA, Nagoya-shi, Aichi (JP)

(72) Inventor: Yutaka Takagiwa, Kariya (JP)

(73) Assignee: BROTHER KOGYO KABUSHIKI KAISHA, Nagoya-Shi (JP)

( * ) Notice: Subject to any disclaimer, the term of this patent is extended or adjusted under 35 U.S.C. 154(b) by 0 days.

(21) Appl. No.: 14/638,599

(22) Filed: Mar. 4, 2015

(65) Prior Publication Data

US 2015/0273843 A1 Oct. 1, 2015

(30) Foreign Application Priority Data

Mar. 31, 2014 (JP) ..... 2014-074592

(51) Int. Cl.
*B41J 2/175* (2006.01)

(52) U.S. Cl.
CPC .... *B41J 2/17513* (2013.01); *B41J 2002/17516* (2013.01)

(58) Field of Classification Search
None
See application file for complete search history.

(56) References Cited

U.S. PATENT DOCUMENTS 3,874,934 A * 4/1975 Zangrando ..... H01M 6/38 429/79
4,765,512 A * 8/1988 Bull, Jr. ..... B67D 1/0001 222/100
5,560,518 A 10/1996 Catterall et al.
6,315,402 B1 * 11/2001 Kawase ..... B41J 2/17513 347/85
6,331,053 B1 12/2001 Seccombe et al.
2009/0289972 A1 11/2009 Iino
2010/0225716 A1 * 9/2010 Hayakawa ..... B41J 2/17509 347/86
2012/0327162 A1 12/2012 Mizuno
2015/0273841 A1 10/2015 Takagiwa
2015/0273844 A1 10/2015 Takagiwa

FOREIGN PATENT DOCUMENTS

JP 09300583 A * 11/1997
JP 2002-361882 A 12/2002
JP 2010-105195 A 5/2010
JP 2013-006349 A 1/2013

OTHER PUBLICATIONS

U.S. Appl. No. 14/638,646, filed Mar. 4, 2015, Cartridge Case.
U.S. Appl. No. 14/638,804, filed Mar. 4, 2015, Cartridge Case.
Office Action issued on Jan. 25, 2016 in the related U.S. Appl. No. 14/638,646.

* cited by examiner

*Primary Examiner* — Justin Seo
(74) *Attorney, Agent, or Firm* — Fox Rothschild LLP

(57) ABSTRACT

A first case has a first surface parallel to a first direction to place a bag thereon. A second case has a second surface facing the first surface. An elastic member is provided on the first surface and generates restoring force in the first direction by extending in a second direction. A shaft portion takes up an end portion at the second direction side of the elastic member then moves to the first direction by the restoring force and takes up the bag. Either end portion of the first case in a third direction has a first protruding portion. Either end portion of the second case in the third direction has a second protruding portion. Either end portion of the shaft portion in the third direction has a protruding end portion. The first and second protruding portion guide the protruding end portion.

10 Claims, 23 Drawing Sheets

CARTRIDGE CASE

CROSS-REFERENCE TO RELATED APPLICATION

This application claims priority to Japanese Patent Application No. 2014-074592 filed on Mar. 31, 2014, the disclosure of which is herein incorporated by reference in its entirety.

BACKGROUND

The present disclosure relates to a cartridge case that supports a liquid storage body having a bag that stores a liquid.

In related art, a cartridge is known that has a shaft portion that applies pressure to an ink pack. For example, an ink tank of the related art is provided with a bag, an ink lead-out opening, a case, a pressure roller and a pressure roller spring. The ink lead-out opening is connected to the bag. The bag is formed of a flexible material. The case seals the bag. The pressure roller spring that is provided on the case energizes the pressure roller. The energized pressure roller takes up and flattens the bag, thus causing the bag to be in a pressurized state. The ink comes out from the bag that is in the pressurized state, via the ink lead-out opening. Pressure roller holders are positioned around both end portions of the pressure roller. Ratchet guides, which have serrated irregularities, guide the pressure roller holders while the pressure roller moves. The ratchet guides are formed in hole portions on the inside of wall portions positioned at both the end portions of the pressure roller.

SUMMARY

To arrange both the end portions of the pressure roller in the ratchet guides, it is necessary to arrange pressure roller holders in both the end portions of the pressure roller pressure roller and also to insert pressure roller holders into the ratchet guides formed in the hole portions on the inside of the wall portions. As a result, an operation to assemble a case of an ink tank is complex.

Various exemplary embodiments of the general principles described herein provide a cartridge case that can be easily assembled.

A cartridge case of an embodiment configured to support a liquid storage body having a bag that stores a liquid, the cartridge case comprising: a first case having a first surface at a bottom thereof, the first surface being capable of placing the bag thereon, the first case extending in a first direction parallel to the first surface; a second case extending in the first direction and having a second surface facing the first surface; a shaft portion configured to move in the first direction with taking up the bag due to a restoring force of an elastic member by taking up an end portion on a second direction side of the elastic member, the elastic member being configured to generate the restoring force in the first direction by extending in the second direction opposite to the first direction, the shaft portion extending in a third direction that is a direction parallel to the first and the second surfaces and orthogonal to the first direction; first protruding portions that are protruding portions provided on end portions in the third direction of the first case, each of the first protruding portions being formed extending across the first direction in a manner of protruding from each of the end portions in the third direction of the first case; second protruding portions that are protruding portions provided on end portions in the third direction of the second case and formed extending across the first direction, each of the second protruding portions protruding from each of the end portions in the third direction of the second case toward the first surface in a manner of facing one of the first protruding portions; and protruding end portions that protrude in the third direction from each of a pair of end portions in the third direction of the shaft portion, the protruding end portions being guided by the first protruding portions and the second protruding portions.

BRIEF DESCRIPTION OF THE DRAWINGS

Embodiments will be described below in detail with reference to the accompanying drawings in which.

DETAILED DESCRIPTION

Figure 1:
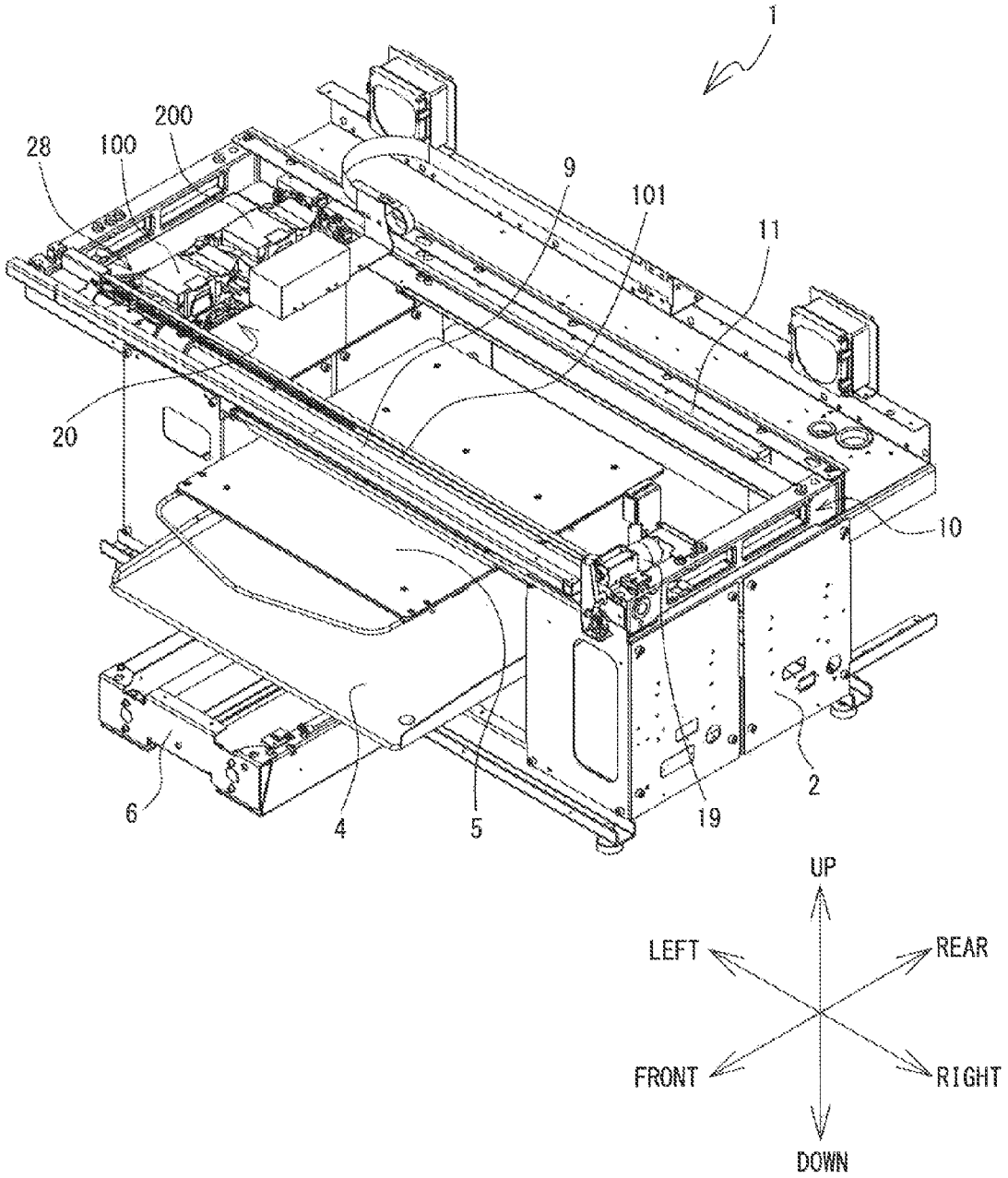
FIG. 1 is a perspective view of a printer.
Figure 2:
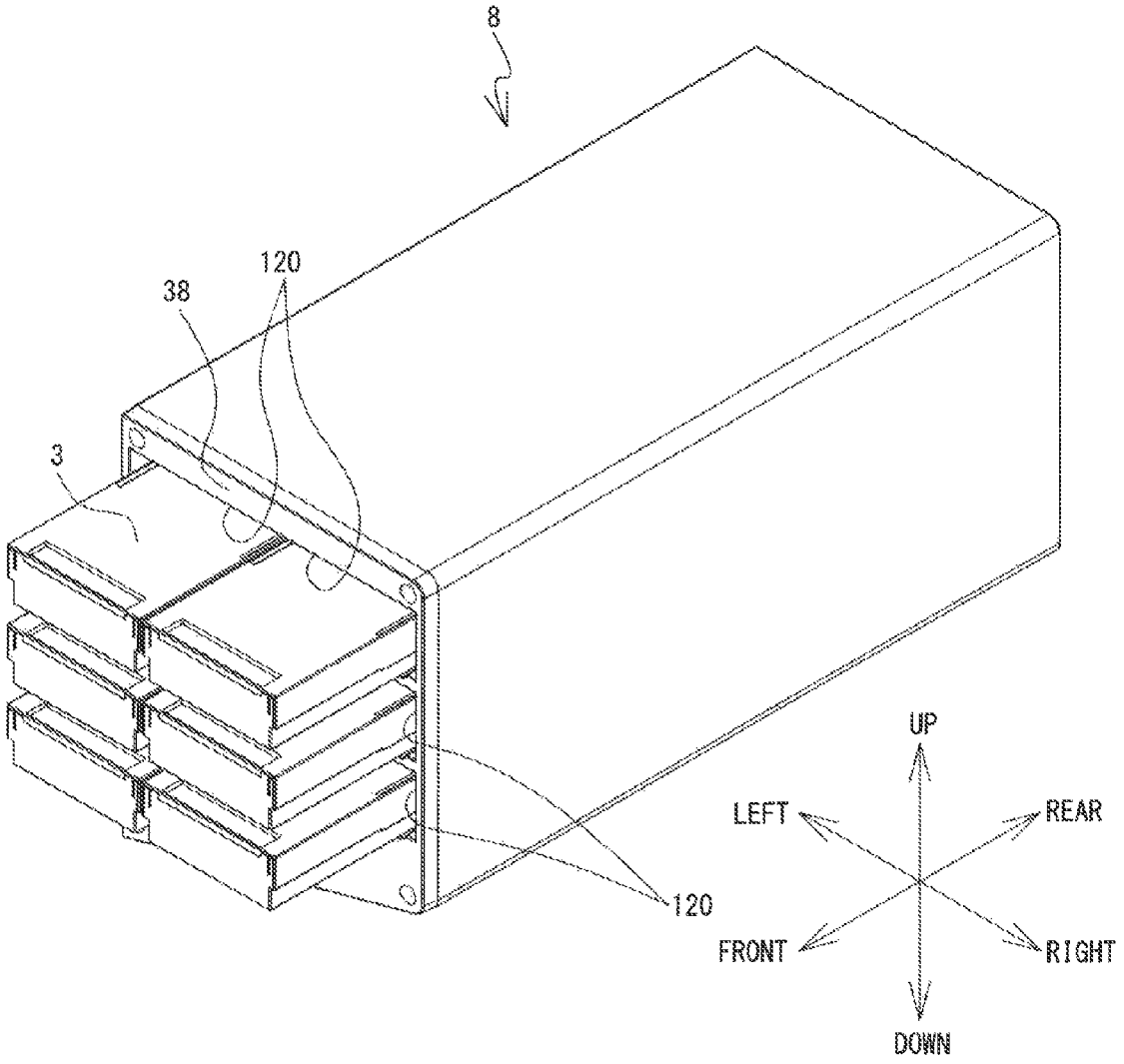
FIG. 2 is a perspective view of a cartridge mounting portion.

An up-down direction, a left-right direction and a front-rear direction indicated by arrows in FIG. 1 respectively denote an up-down direction, a left-right direction and a front-rear direction of a printer 1. Arrows in FIG. 2 are the same.

As shown in FIG. 1, the printer 1 is an inkjet printer. The printer 1 discharges a liquid ink onto a print medium (not shown in the drawings). In the present embodiment, the print medium is a fabric, such as a T-shirt or the like. The print medium may be paper or the like. The printer 1 of the present embodiment can discharge five types of ink in a downward direction. The printer 1 can perform color printing on a fabric. The five types of ink are white (W), black (K), yellow (Y), cyan (C) and magenta (M).

The printer 1 is mainly provided with a housing 2, a platen drive mechanism 6, a platen 5, a tray 4, a frame body 10, a guide shaft 9, a rail 11, a carriage 20, a support portion (not shown in the drawings), head units 100 and 200, a drive belt 101 and a drive motor 19.

The housing 2 is a substantially cuboid shape that extends in the left-right direction. An operating portion (not shown in the drawings) is provided on a right front portion of the housing 2. The operating portion is provided with a display and operating buttons. The display displays various types of information. A user operates the operating buttons when inputting commands relating to various operations of the printer 1.

A pair of guide rails (not shown in the drawings) are provided inside the platen drive mechanism 6. The pair of guide rails extend in the front-rear direction. The pair of guide rails support the platen 5 and the tray 4. The platen 5 and the tray 4 can move along the pair of guide rails. A driving source of the platen drive mechanism 6 is a motor (not shown in the drawings). The motor is positioned on a rear end portion of the platen drive mechanism 6. The platen 5 and the tray 4 move along the pair of guide rails due to a driving force of the motor. The platen 5 is a substantially rectangular shaped plate that extends in the front-rear direction. The platen 5 is positioned below the frame body 10. The fabric is placed on an upper surface of the platen 5. The tray 4 is a rectangular shape. The tray 4 is positioned below the platen 5. When the user places a T-shirt on the platen 5, the tray 4 holds the sleeves of the T-shirt. Thus, the sleeves do not fall inside the housing 2.

The frame body 10 is a substantially rectangular shaped frame. The frame body 10 is positioned above the housing 2. The guide shaft 9 and the rail 11 are provided inside the frame body 10. The frame body 10 supports the guide shaft 9 and the rail 11. The guide shaft 9 is a shaft member that extends in the left-right direction. The rail 11 is a rod-shaped member that extends in the left-right direction. The rail 11 faces the guide shaft 9. The guide shaft 9 and the rail 11 are mutually separated in the front-rear direction.

The guide shaft 9 and the rail 11 support the carriage 20. The carriage 20 can move in the left-right direction. The head units 100 and 200 are mounted on the carriage 20. Bottom surfaces of each of the head units 100 and 200 have head portions (not shown in the drawings). The head portions are provided with a plurality of fine nozzles. The head portions discharge droplets of ink in a downward direction from the nozzles as a result of operation of a piezoelectric element.

The flexible drive belt 101 is a belt shape that is stretched along the inside of the frame body 10 in the left-right direction. The drive belt 101 is made of synthetic resin. The drive motor 19 is positioned inside the frame body 10 and to the front right side. The drive motor 19 is positioned between the guide shaft 9 and the rail 11 in the front-rear direction. The drive motor 19, which is able to rotate in the positive and reverse directions, is coupled to the carriage 20 via the drive belt 101. An overview of a printing operation by the printer 1 on the fabric is as follows. When the drive motor 19 drives the drive belt 101, the carriage 20 reciprocates in the left-right direction and the head portions of the head units 100 and 200 thus reciprocate in the left-right direction. The platen 5 feeds the fabric in the front-rear direction. The feed direction of the fabric by the platen 5 is the front-rear direction. The ink is discharged by the head portions that are reciprocating in the left-right direction.

Figure 3:
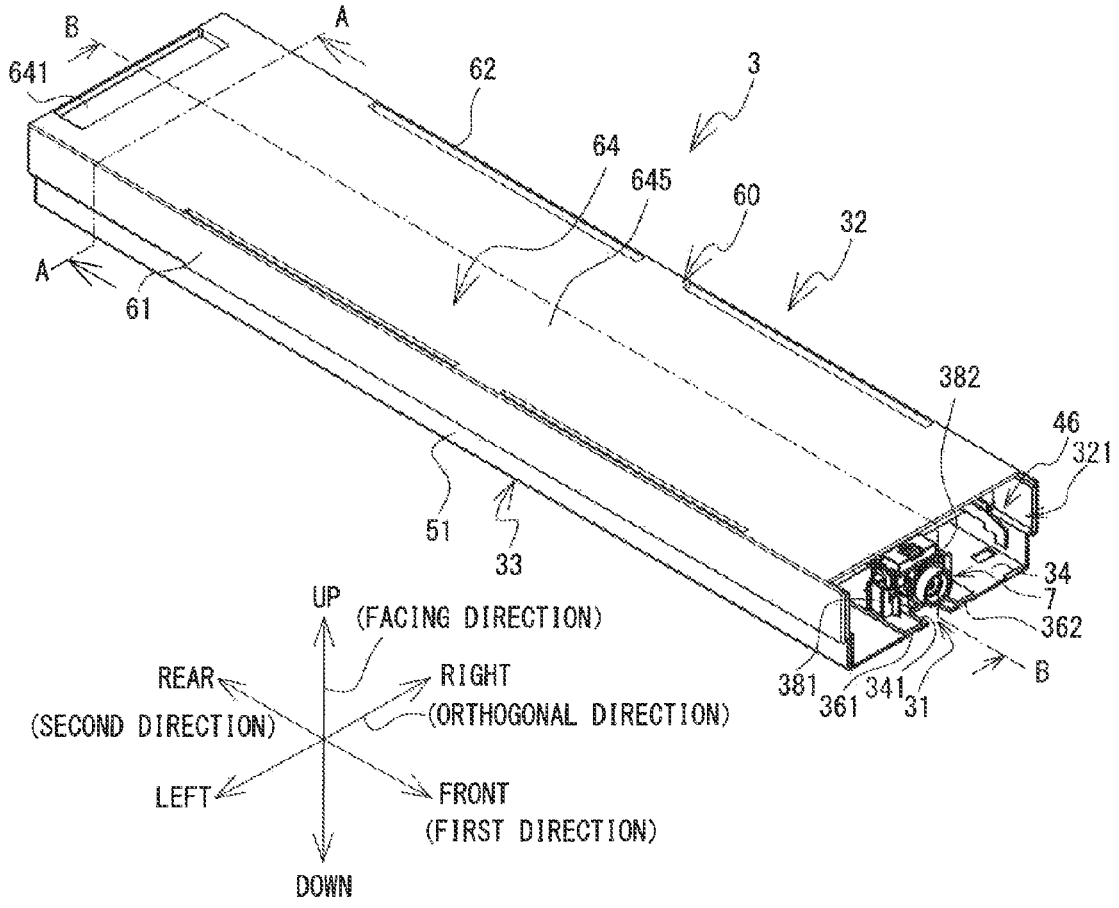
FIG. 3 is a perspective view of a cartridge.

The cartridge mounting portion 8 shown in FIG. 2 is adjacent to the housing 2, on the outside and to the right of the housing 2. A plurality of cartridges 3 (six in the present embodiment) can be mounted in the cartridge mounting portion 8. The cartridges 3 that are mounted in the cartridge mounting portion 8 supply ink to the head portions of the head units 100 and 200. A frame portion 38 on a front portion of the cartridge mounting portion 8 has a plurality of open portions 120. The cartridge 3 can be inserted into and removed from the open portion 120. The frame portion 38 has three columns of the open portions 120 in the up-down direction and two rows of the open portions 120 in the left-right direction. As shown in FIG. 3, the cartridge 3 houses a liquid storage body 31. The liquid storage body 31 has a plug 7. The plug 7 has a rubber plug (not shown in the drawings). When the cartridge 3 is mounted in the cartridge mounting portion 8, a hollow needle (not shown in the drawings) that leads out the liquid from the liquid storage body 31 pierces the rubber plug (not shown in the drawings).

Figure 4:
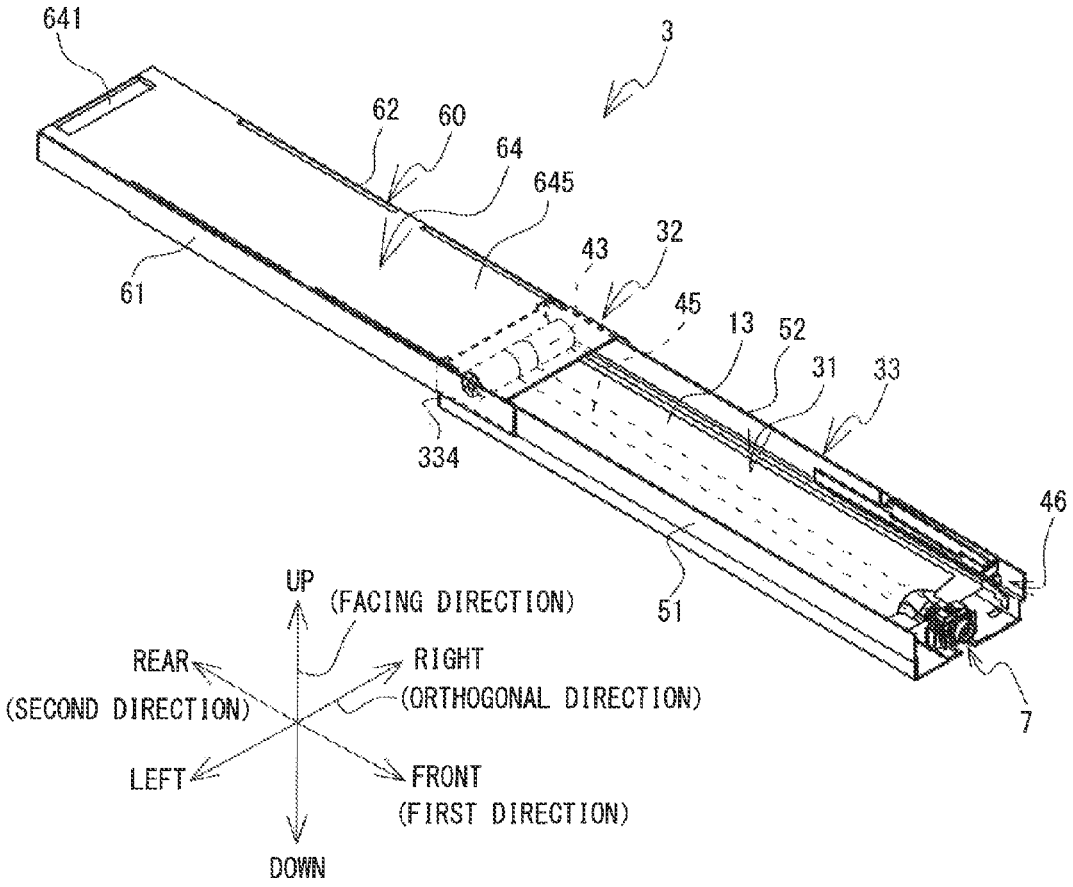
FIG. 4 is a perspective view of the cartridge.

The cartridge 3 will be explained in detail with reference to FIG. 3 to FIG. 16D. In the following explanation, the up-down direction, the left-right direction and the front-rear direction indicated by arrows shown in FIG. 3 respectively denote the up-down direction, the left-right direction and the front-rear direction of the cartridge 3. For ease of explanation, the left-right direction and the front-rear direction of the cartridge 3 shown in FIG. 3 are changed from those of the printer 1 shown in FIG. 2. The direction indicating arrows in FIG. 4 are the same as those shown in FIG. 3. The direction indicating arrows shown in FIG. 5 onward are adjusted such that they match the arrows shown in FIG. 3. As shown in FIG. 3 and FIG. 4, the cartridge 3 is provided with the liquid storage body 31 and a case 32. The case 32 houses the liquid storage body 31.

Figure 5:
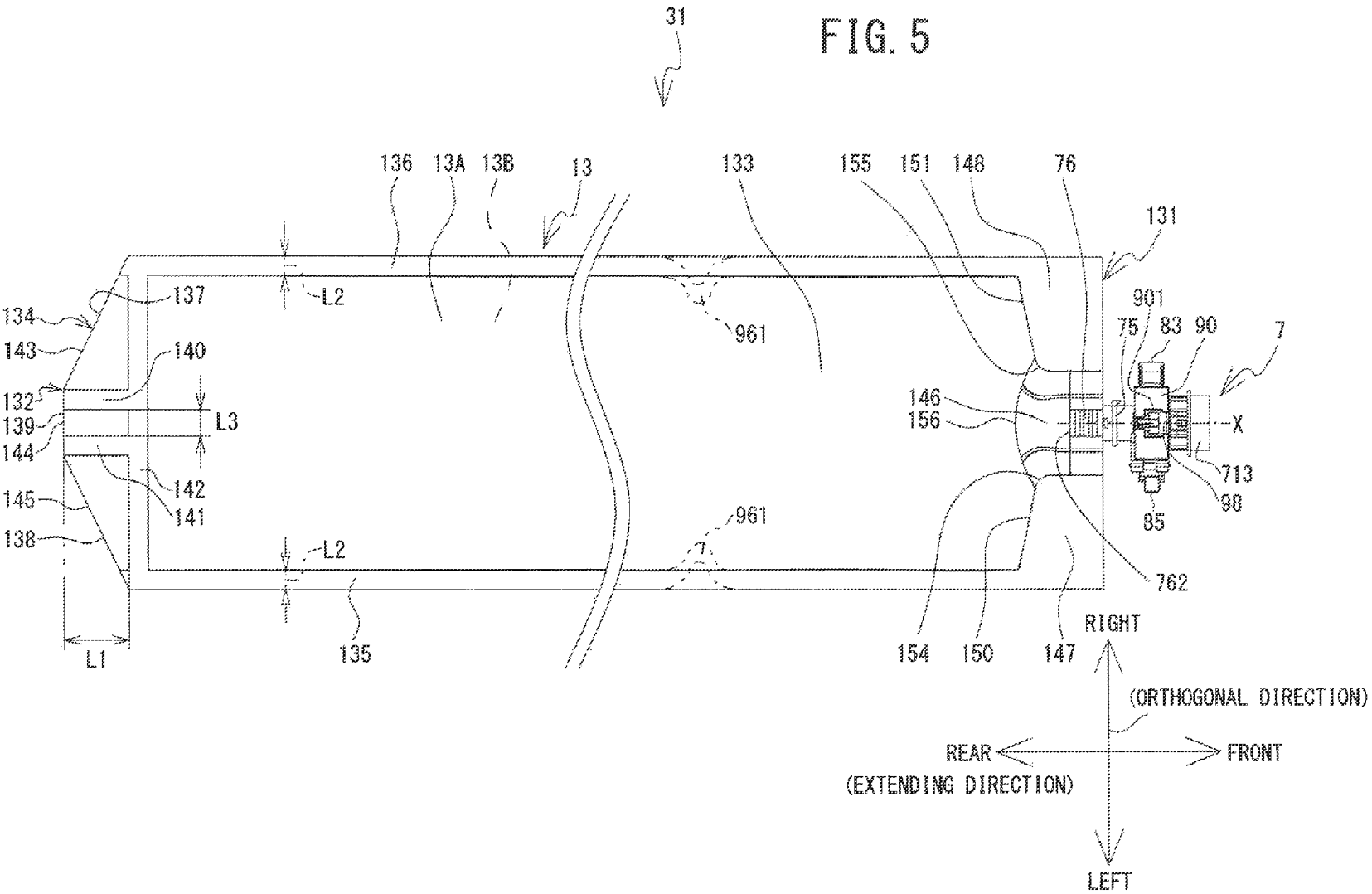
FIG. 5 is a plan view of a liquid storage body.
Figure 6:
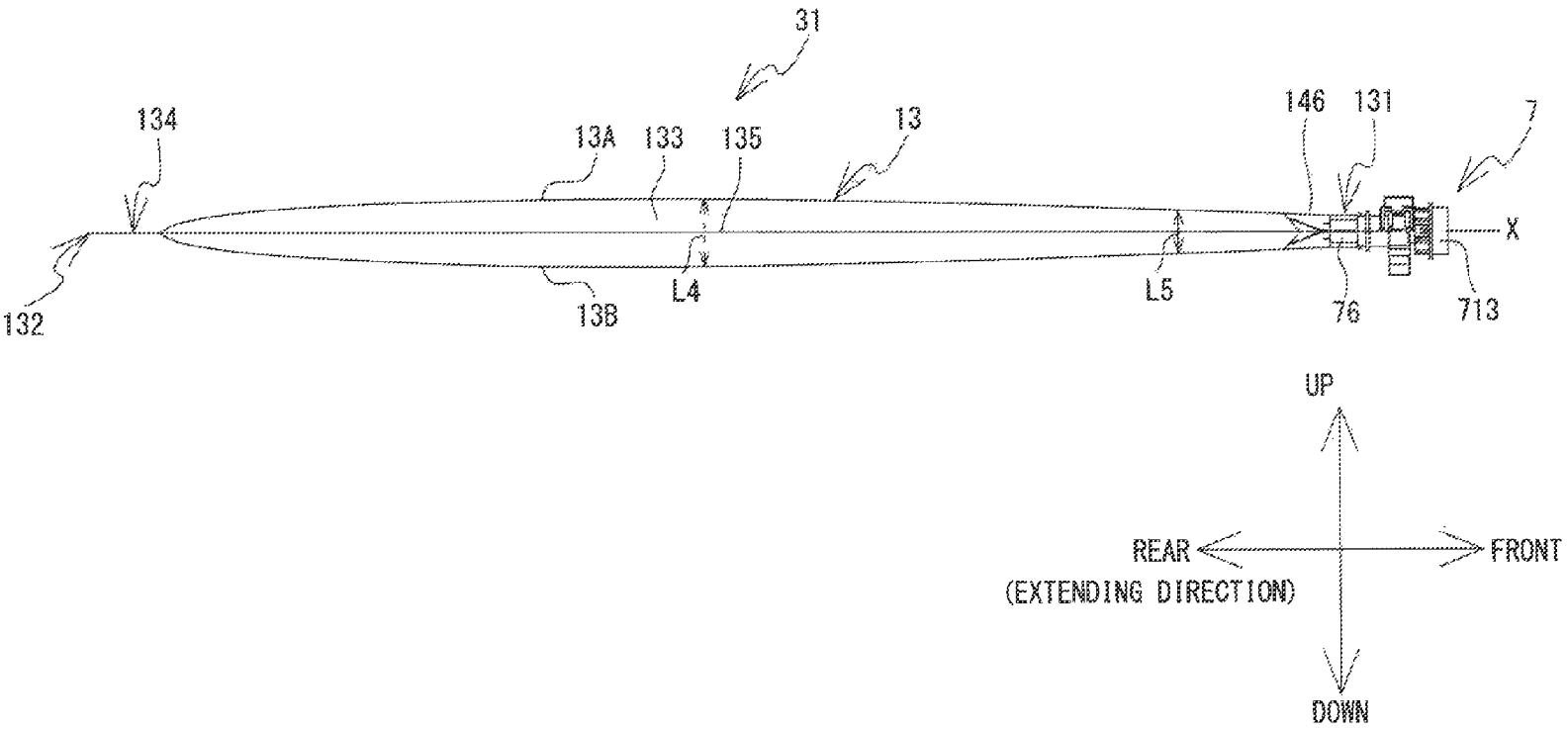
FIG. 6 is a left side view of the liquid storage body.

As shown in FIG. 4 and FIG. 5, the liquid storage body 31 is provided with a liquid storage bag 13 and the plug 7. As shown in FIG. 5 and FIG. 6, the liquid storage bag 13 is a bag shaped container. The liquid storage bag 13 is provided with two flexible sheets 13A and 13B that are made of synthetic resin and that have a rectangular shape. The sheets 13A and 13B are overlapped with each other and are connected by their edge portions being thermally welded. The liquid storage bag 13 extends in the front-rear direction. In the following explanation, the front end portion of the liquid storage bag 13 is referred to a first end portion 131 and the rear end portion of the liquid storage bag 13 that is opposite to the first end portion 131 is referred to as a second end portion 132. The rearward direction from the first end portion 131 toward the second end portion 132 is also referred to as an "extending direction." A surface of the sheet 13A or 13B is also referred to as a "sheet surface." The left-right direction that is orthogonal to the extending direction and is generally parallel to the sheet surface of the liquid storage bag 13 in which liquid is not stored is also referred to as an "orthogonal direction" or a "third direction."

The liquid storage bag 13 will be explained in detail. As shown in FIG. 5, the liquid storage bag 13 is provided with a liquid storage portion 133 and an extension portion 134. The liquid storage portion 133 includes the first end portion 131 and extends toward the rear, which is the extending direction. The liquid storage portion 133 internally stores a liquid. Examples of the liquid include ink and a discharging agent. The discharging agent removes color from dyed fabric. The liquid of the present embodiment is ink.

The extension portion 134 is a portion which does not store the ink. The extension portion 134 is connected to the liquid storage portion 133 on the side of the second end portion 132. The extension portion 134 extends from the liquid storage portion 133 in the extending direction. At end portions of the liquid storage portion 133 in the orthogonal direction, portions of the two sheets 13A and 13B that are connected to each other by the thermal welding are referred to as edge portions 135 and 136. At an end portion of the liquid storage portion 133 in the extending direction, a portion of the two sheets 13A and 13B that are connected to each other by the thermal welding in the orthogonal direction is referred to as a rear edge portion 142. The edge portions 135 and 136 extend as far as the extension portion 134. A length L1 of the extension portion 134 in the extending direction is longer than a length L2 of the edge portions 135 and 136 in the orthogonal direction.

The extension portion 134 is provided with tapered portions 137 and 138, first connected portions 140 and 141 and open portions 143, 144 and 145. The tapered portions 137 and 138 are portions that shorten the length of the extension portion 134 in the orthogonal direction such that the extension portion 134 tapers toward the extending direction. An end edge of the extension portion 134 in the extending direction is parallel to the orthogonal direction. The end edge is positioned in a central portion of the extension portion 134 in the orthogonal direction. Therefore, the end edge is hereinafter referred to as a "central portion 139."

The first connected portions 140 and 141 are portions of the extension portion 134 at which the two sheets 13A and 13B are thermally welded to each other. The first connected portions 140 and 141 are positioned further to the inside, in the orthogonal direction, than the edge portions 135 and 136. The first connected portion 140 extends in the extending direction from the rear edge portion 142 and reaches a right end portion of the central portion 139. The first connected portion 141 extends in the extending direction from the rear edge portion 142 and reaches a left end portion of the central portion 139. An inner position from both the edge portion 135 and the edge portion 136 is included in a rear-side area from a rear end of the edge portions 135 and 136 and a front-side area from a front end of the edge portions 135 and 136. The length of the extension portion 134 in the extending direction is referred to as the length L1. An interval in the orthogonal direction between the first connected portions 140 and 141 is referred to as a length L3. L3 is smaller than L1.

The open portions 143, 144 and 145 are provided on an end portion on the extending direction side of the extension portion 134. The open portions 143, 144 and 145 are provided between the sheets 13A and 13B. The open portions 143, 144 and 145 are portions on the end portion on the extending direction side of the extension portion 134 at which the sheets 13A and 13B are not thermally welded to each other. The open portion 143 is provided in the tapered portion 137. The open portion 144 is provided in the central portion 139 and is positioned between the first connected portion 140 and the first connected portion 141. The open portion 145 is provided in the tapered portion 138.

An insertion portion 76 of the plug 7 is provided between the sheets 13A and 13B at the first end portion 131. A curved area 146 is provided in the first end portion 131. In the curved area 146, the sheets 13A and 13B are curved in a direction to separate from each other (in the up-down direction) along the insertion portion 76. The curved area 146 extends further in the extending direction than the insertion portion 76.

Second connected portions 147 and 148, at which the sheets 13A and 13B are thermally welded to each other, are provided in the first end portion 131. The second connected portions 147 and 148 are positioned further to the outside, in the orthogonal direction, than the insertion portion 76. In other words, the insertion portion 76 is provided between the second connected portions 147 and 148 in the orthogonal direction. The second connected portions 147 and 148 have a substantially rectangular shape. The second connected portions 147 and 148 are provided, respectively, with corner portions 154 and 155. The corner portions 154 and 155 are positioned on the inside, in the orthogonal direction, of the edge portions 135 and 136 of the liquid storage bag 13 and further to the rear side with respect to the extending direction than the insertion portion 76. The corner portions 154 and 155 are rounded. In the extending direction, the corner portions 154 and 155 are positioned between an end portion 762 of the insertion portion 76 and an end portion 156 of the curved area 146. Sides of the second connected portions 147 and 148 on the extending direction side are referred to as a side 150 and a side 151, respectively. The side 150 is inclined such that the further the side 150 is separated from the side 151 in the orthogonal direction, the further to the extending direction side the side 150 is positioned. The same also applies to the side 151.

Figure 7:
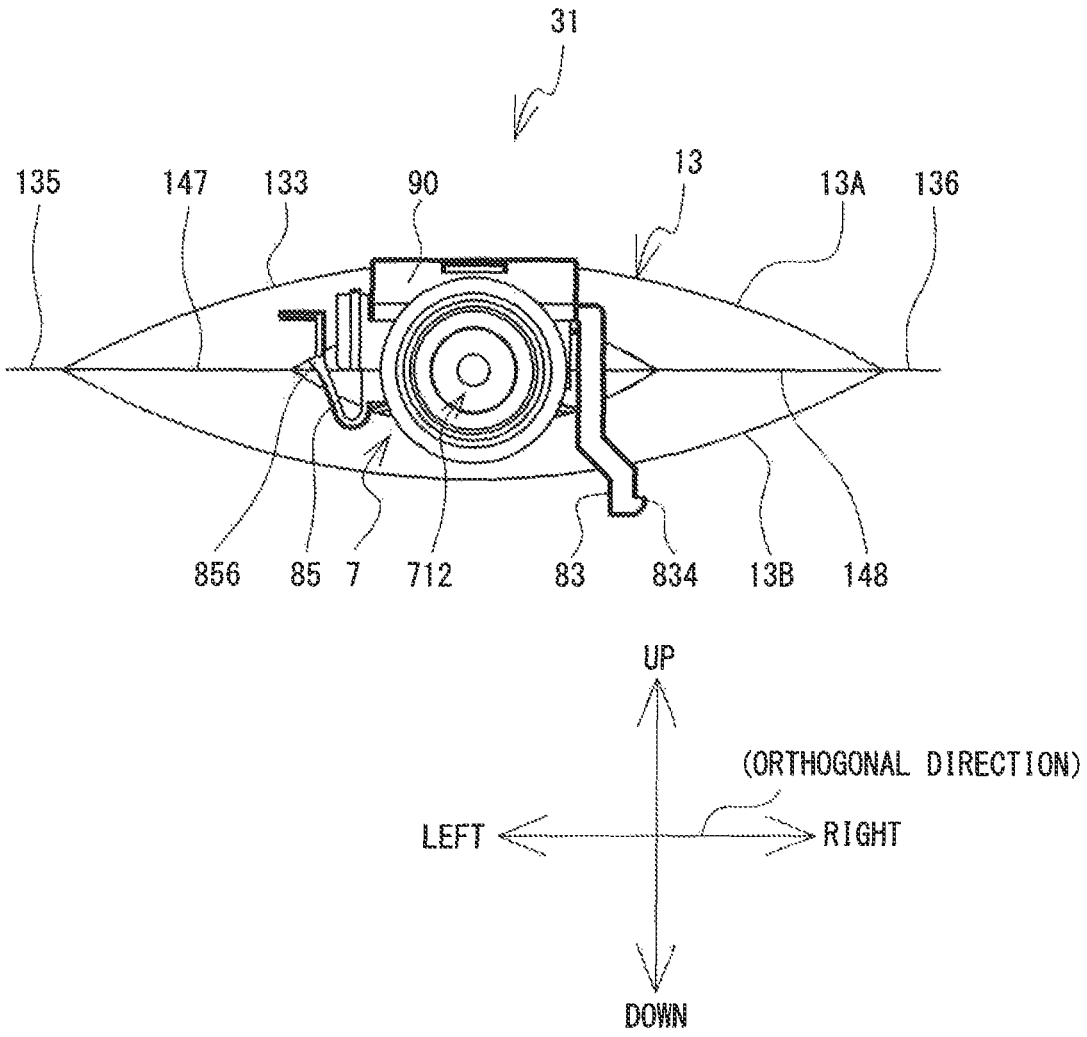
FIG. 7 is a front view of the liquid storage body.

The plug 7 will be explained. As shown in FIG. 5 and FIG. 6, the plug 7 is connected to the first end portion 131 of the liquid storage bag 13. The plug 7 extends in the front-rear direction, which is an X-axis line direction. The X-axis line direction is parallel to the extending direction. The plug 7 is provided with a leading end portion 713, a first plug protruding portion 83, a second plug protruding portion 85, a holder 90, an electric board 98 and the insertion portion 76. The leading end portion 713 on the front side of the plug 7 is a cylindrical shape that extends in the front-rear direction, which is the X-axis line direction. As shown in FIG. 7, the plug 7 has a hollow portion 712. The hollow portion 712 extends toward the rear from the center, in a front view, of the leading end portion 713. The hollow portion 712 causes the interior of the liquid storage portion 133 to communicate with the exterior of the plug 7. The rubber plug (not shown in the drawings) is provided in a part of the hollow portion 712 in the X-axis line direction. The rubber plug seals the hollow portion 712. Therefore, the ink inside the liquid storage portion 133 cannot leak out.

As shown in FIG. 5, the first plug protruding portion 83, the second plug protruding portion 85 and the holder 90 are provided to the rear of the leading end portion 713. As shown in FIG. 7, the first plug protruding portion 83 is positioned to the right of the plug 7. After extending downward from the plug 7, the first plug protruding portion 83 extends diagonally downward and to the right, and the lower end of the first plug protruding portion 83 extends downward. The lower end portion of the first plug protruding portion 83 is provided with a first engagement tab 834. The first engagement tab 834 protrudes to the right from the right side surface on the lower end portion of the first plug protruding portion 83.

The second plug protruding portion 85 is positioned to the left of the plug 7. The second plug protruding portion 85 is a curved plate shape, and deforms elastically in the rightward direction toward the plug 7. The second plug protruding portion 85 extends downward from the plug 7. Then, the second plug protruding portion 85 is curved at its lower end and extends upward. The second plug protruding portion 85 is provided with a second engagement tab 856. The second engagement tab 856 protrudes to the left from the left side surface of the second plug protruding portion 85.

Figure 9:
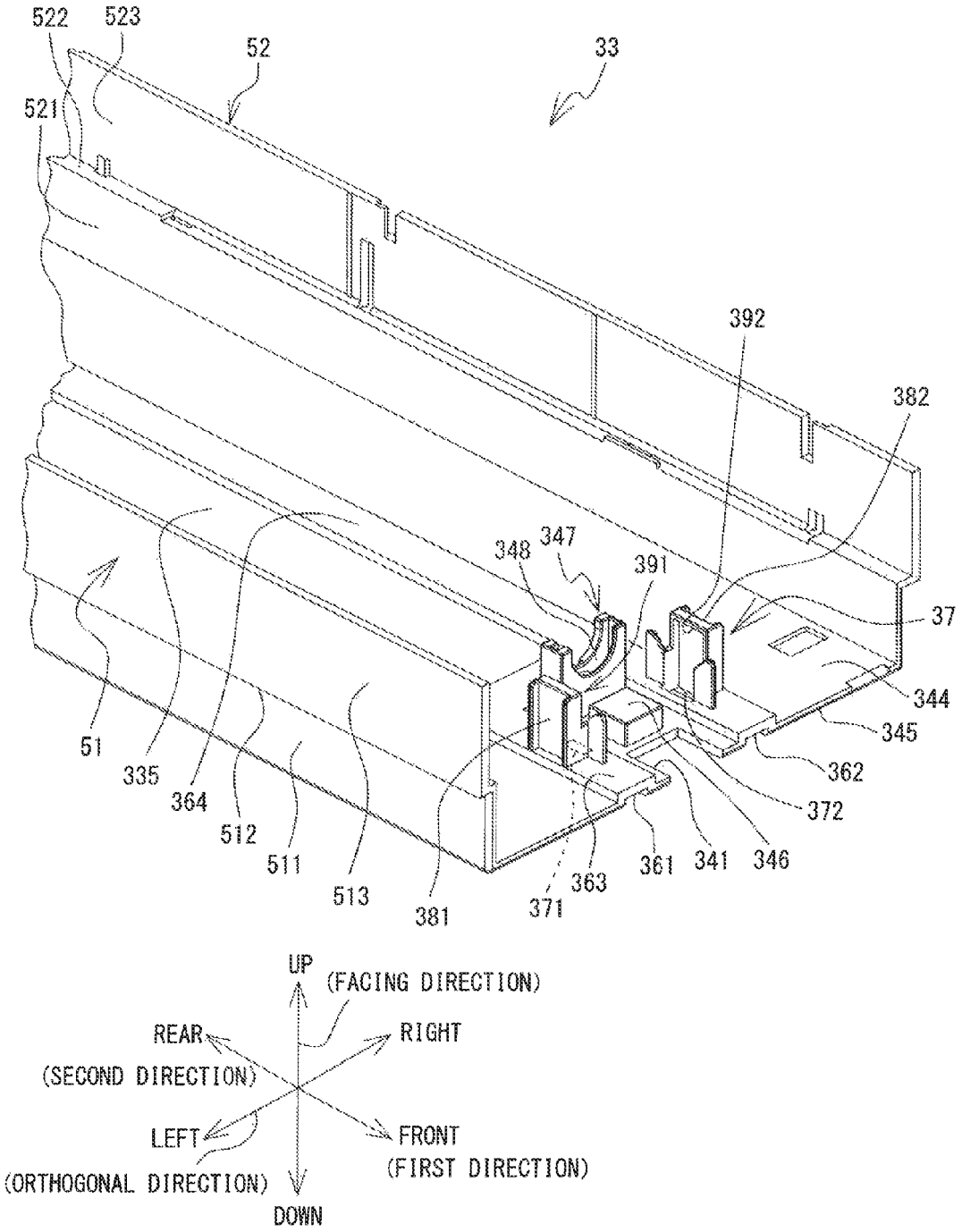
FIG. 9 is a perspective view of a front end portion of a first case.

As shown in FIG. 9, when the liquid storage body 31 is mounted in the case 32, the first plug protruding portion 83 engages with a first open portion 372 of the case 32, and the second plug protruding portion 85 engages with a second open portion 391 of the case 32. Details will be described later.

As shown in FIG. 5 and FIG. 7, the holder 90 is provided above the plug 7. A holder opening 901, which is an open portion, is provided in the top surface of the holder 90. The holder 90 holds the electric board 98. The holder opening 901 exposes the top surface of the electric board 98. A placement portion 75 is provided on the extending direction side of the holder 90. The placement portion 75 is a flange shape that protrudes to the outside from the periphery of the plug 7. It is not necessary for the holder 90 to hold the electric board 98.

The insertion portion 76 is an end portion in the extending direction of the plug 7. The insertion portion 76 is a cylindrical shape that extends in the extending direction. The insertion portion 76 is provided in a state of being arranged between the sheets 13A and 13B and thus being inserted inside the liquid storage portion 133. The sheets 13A and 13B are thermally welded with the insertion portion 76 sandwiched therebetween.

The case 32 will be explained. In the following explanation, the frontward direction is also referred as a "first direction." The rearward direction, which is the opposite direction to the first direction, is also referred to as a "second direction." The up-down direction, in which a first inner surface 344 and a second inner surface 644 that will be explained later aligned facing each other, is also referred to as a "facing direction."

Figure 8:
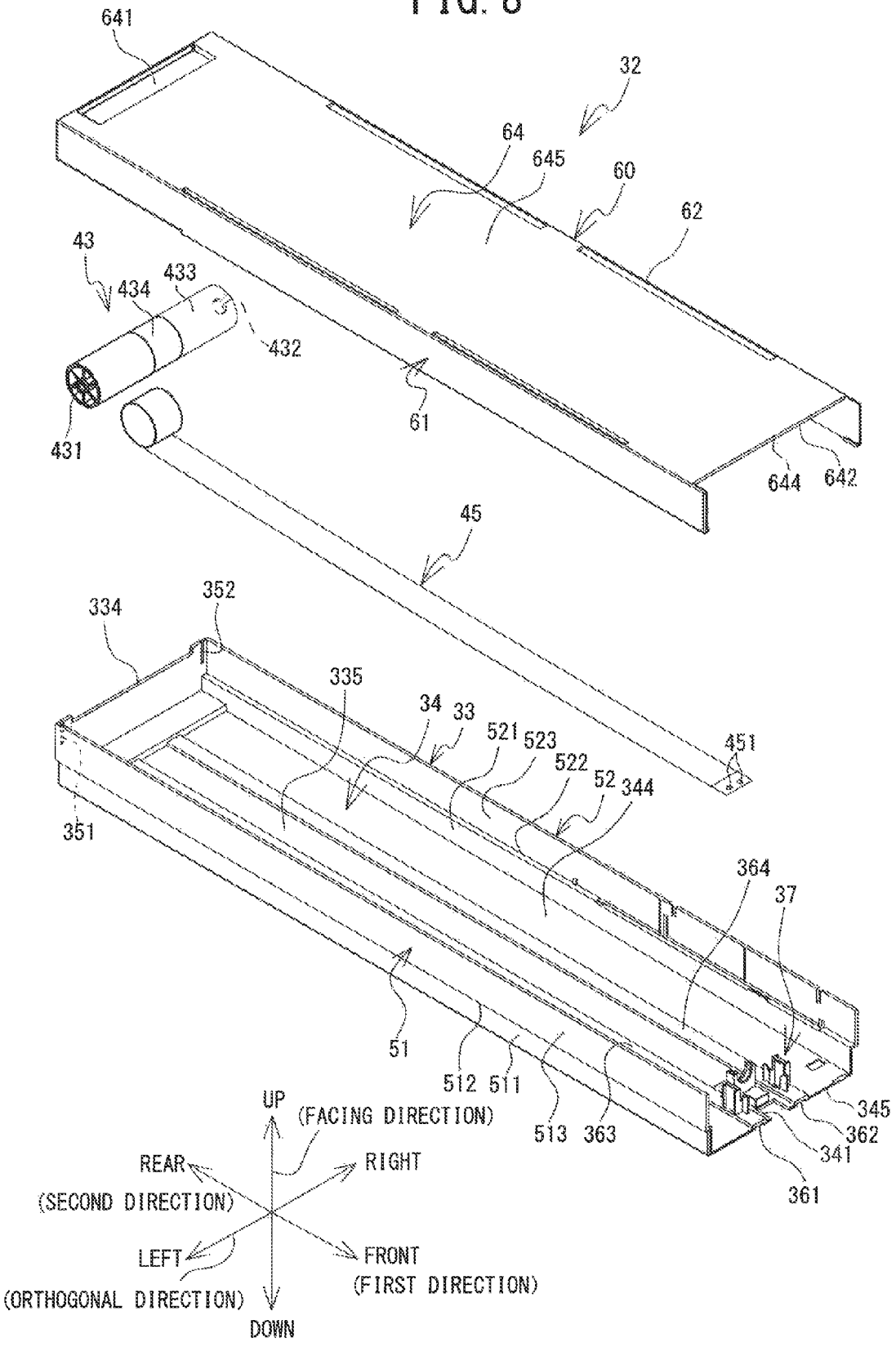
FIG. 8 is an exploded perspective view of a case.

As shown in FIG. 3, the case 32 has a box-shape which is long in the front-rear direction. The case 32 has an end open portion 321 which opens at an end portion of the case 32 on the first direction side. As shown in FIG. 3, FIG. 4 and FIG. 8, the case 32 includes a first case 33, a second case 60, a shaft portion 43, an elastic member 45 and a detection portion 46. The first case 33 supports the liquid storage body 31. The second case 60 is arranged above the first case 33. The second case 60 is capable of sliding with respect to the first case 33 in the first direction and the second direction (refer to FIG. 3 and FIG. 4).

Figure 10:
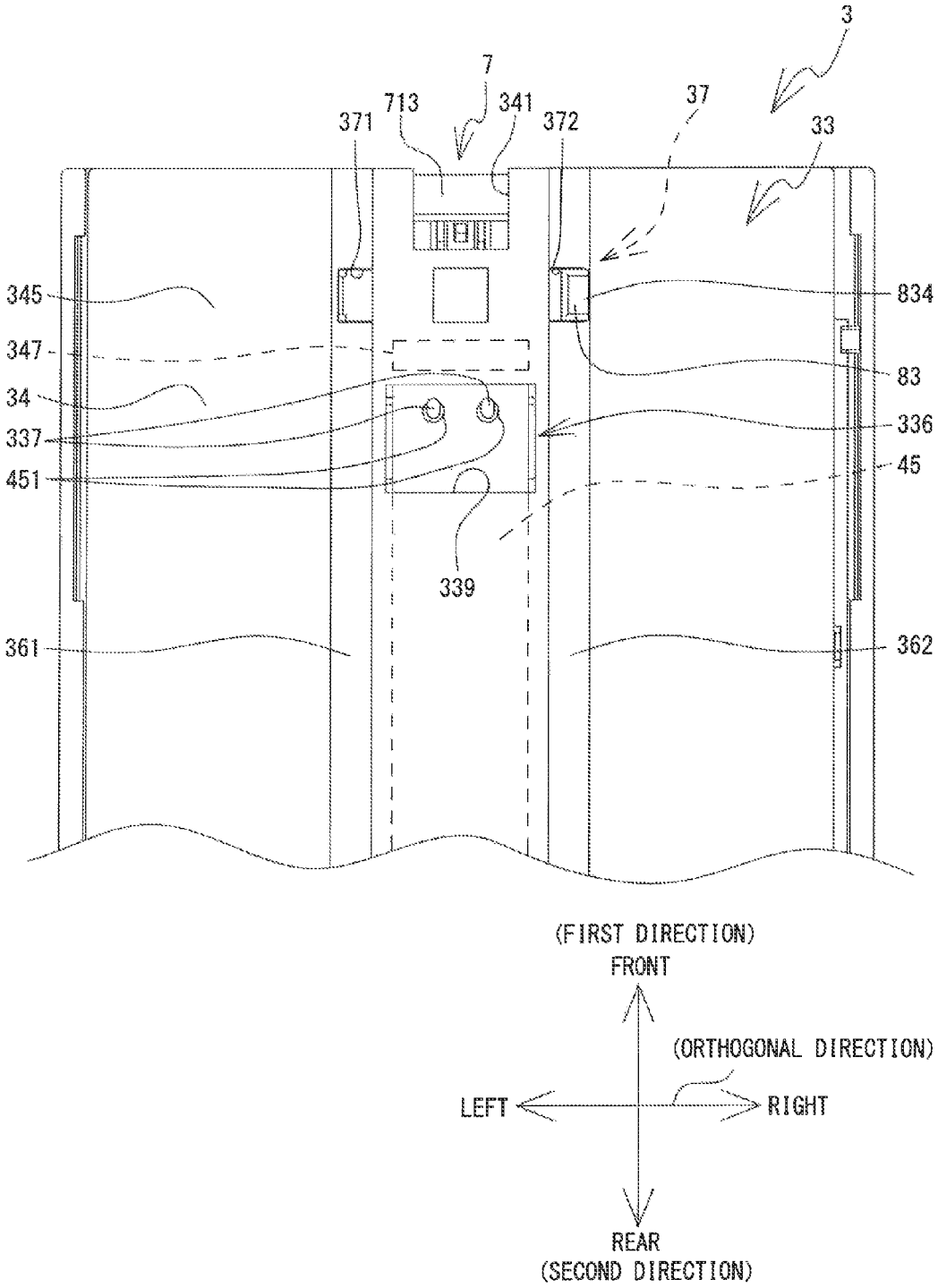
FIG. 10 is a bottom view of a front end portion of the cartridge.

As shown in FIG. 8, the first case 33 is provided with a support wall portion 34, a pair of side walls 51 and 52, a rear wall portion 334, a case recessed portion 335 and a mounting portion 336 (refer to FIG. 10). The support wall portion 34 is provided with the upper-side first inner surface 344 that extends in the first direction from the rear end side of a bottom portion of the first case 33, and with a first outer surface 345 that is on the opposite side to the first inner surface 344. The orthogonal direction is a direction that is parallel to the first inner surface 344 and that is orthogonal to the first direction. The pair of side walls 51 and 52 extend upward from the end portion in the orthogonal direction of the first inner surface 344. The rear wall portion 334 extends upward from the rear end portion of the first inner surface 344. The end portion in the orthogonal direction of the rear wall portion 334 is provided with slits 351 and 352 that extend downward from the upper end of the rear wall portion 334. When the second case 60 slides in the second direction with respect to the first case 33, protruding wall portions 65 and 66 (refer to FIG. 11, to be explained later) of the second case 60 pass through the inside of the slits 351 and 352. The end portion of the first case 33 on the first direction side is an open portion that does not have a wall portion.

As shown in FIG. 8 and FIG. 9, a recessed portion 341 that is recessed in a rectangular shape toward the second direction is provided in the center, in the left-right direction, of the end portion of the support wall portion 34 on the first direction side. The first outer surface 345 is provided with two groove portions 361 and 362 that are recessed in the upward direction. The groove portion 361 is provided to the left of the recessed portion 341, and extends from the front end of the support wall portion 34 to a front side of the rear end. The groove portion 362 is provided to the right of the recessed portion 341 and extends from the front end of the support wall portion 34 to the front side of the rear end. By providing the groove portions 361 and 362 in the first outer surface 345, protruding portions 363 and 364 that protrude upward are provided above the groove portions 361 and 362 in the first inner surface 344.

As shown in FIG. 9, a plug support portion 37 that supports the plug 7 is provided to the rear of the recessed portion 341. The plug support portion 37 includes a first open portion 371 and the first open portion 372, open wall portions 381 and 382, a first support portion 346 and a second support portion 347. Each of the first open portions 371 and 372 is formed in a rectangular shape in a plan view and penetrates the support wall portion 34 in the up-down direction, at a front portion of each of the groove portions 361 and 362, respectively (refer to FIG. 9 and FIG. 10). The open wall portions 381 and 382 extend upward from the protruding portions 363 and 364, respectively. The open wall portions 381 and 382 are respectively provided with the second open portion 391 and a second open portion 392, which have a rectangular shape in a side view and which are respectively provided on the inside of the open wall portions 381 and 382 in the orthogonal direction. The first open portion 371 is provided on the surface of the protruding portion 363 at a position which is enclosed with the open wall portions 381 and 382 in the orthogonal direction, wherein each of the open wall portions 381 and 382 forms the second open portion 391 and a second open portion 392, respectively. In the same manner, the first open portion 372 is provided on the surface of the protruding portion 364 at a position which is enclosed with the open wall portions 381 and 382 in the orthogonal direction.

When the liquid storage body 31 is mounted in the first case 33, the lower end of the first plug protruding portion 83 of the plug 7 protrudes from the first open portion 372 and is positioned in the groove portion 362. The first engagement tab 834 engages with the groove portion 362 (refer to FIG. 10). The second engagement tab 856 engages with the second open portion 391. The first open portions 371 and 372 are symmetrical with each other in the orthogonal direction with the first support portion 346 (to be explained later) as a center point between them. The second open portions 391 and 392 are symmetrical with each other in the orthogonal direction with the first support portion 346 as the center point between them. Thus, for example, when the plug 7 is a plug on which the first plug protruding portion 83 is arranged on the left side and the second plug protruding portion 85 is arranged on the right side, the lower end of the first plug protruding portion 83 protrudes from the first open portion 371 and is positioned in the groove portion 361. The first engagement tab 834 engages with the groove portion 361. The second engagement tab 856 engages with the second open portion 391.

As shown in FIG. 9, the first support portion 346 is positioned on the second direction side of the recessed portion 341 in the support wall portion 34 and is also positioned between the groove portion 361 and the groove portion 362. The first support portion 346 has a rectangular shape in a plan view and protrudes upward. The first support portion 346 supports the bottom surface of the plug 7. The second support portion 347 is provided on the second direction side of the first support portion 346. The second support portion 347 is a wall portion that extends upward from the support wall portion 34 and that is long in the left-right direction. The upper end of the second support portion 347 is recessed downward in a U shape in a front view. A recessed portion 348, which is recessed downward in the left-right direction, is provided in a center portion, in the front-rear direction, of the second support portion 347. When supporting the plug 7 on the plug support portion 37, an operator arranges the lower end of the placement portion 75 (refer to FIG. 5) of the plug 7 in the recessed portion 348 of the second support portion 347.

The case recessed portion 335 is positioned on the second direction side of the plug support portion 37. As shown in FIG. 8, the case recessed portion 335 is a recessed portion that is recessed downward between the protruding portions 363 and 364. The case recessed portion 335 extends in the first direction from a front side of the rear end portion of the support wall portion 34. The elastic member 45 is positioned on the inside of the case recessed portion 335. The case recessed portion 335 supports the elastic member 45. The elastic member 45 is a variable load plate spring.

As shown in FIG. 10, the mounting portion 336 is positioned on the second direction side of the plug support portion 37. The mounting portion 336 is a recessed portion that is formed to open downward and is provided inside of a projection which projects upward from the first inner surface 344 and the first outer surface 345 that is a bottom face of the first case 33. The mounting portion 336 is provided with two protrusions 337 that protrude downward from the first outer surface 345. The two protrusions 337 are aligned side by side in the orthogonal direction.

The case recessed portion 335 is provided with a mounting open portion 339. The mounting open portion 339 penetrates the support wall portion 34 in the up-down direction, on the second direction side of the mounting portion 336. The end portion on the first direction side of the elastic member 45 is provided with two round hole portions 451 that are aligned side by side in the orthogonal direction. When the elastic member 45 is arranged in the case recessed portion 335 and mounted in the mounting portion 336, the end portion on the first direction side of the elastic member 45 is positioned on the side of the first outer surface 345, via the mounting open portion 339. The two protrusions 337 are inserted through the inside of the two round hole portions 451. As shown in FIG. 4 and FIG. 8, the elastic member 45 extends in the second direction. The shaft portion 43 takes up the end portion on the second direction side of the elastic member 45. A restoring force in the first direction is generated by the elastic member 45. Thus, the elastic member 45 urges the shaft member 43 in the first direction.

Figure 11:
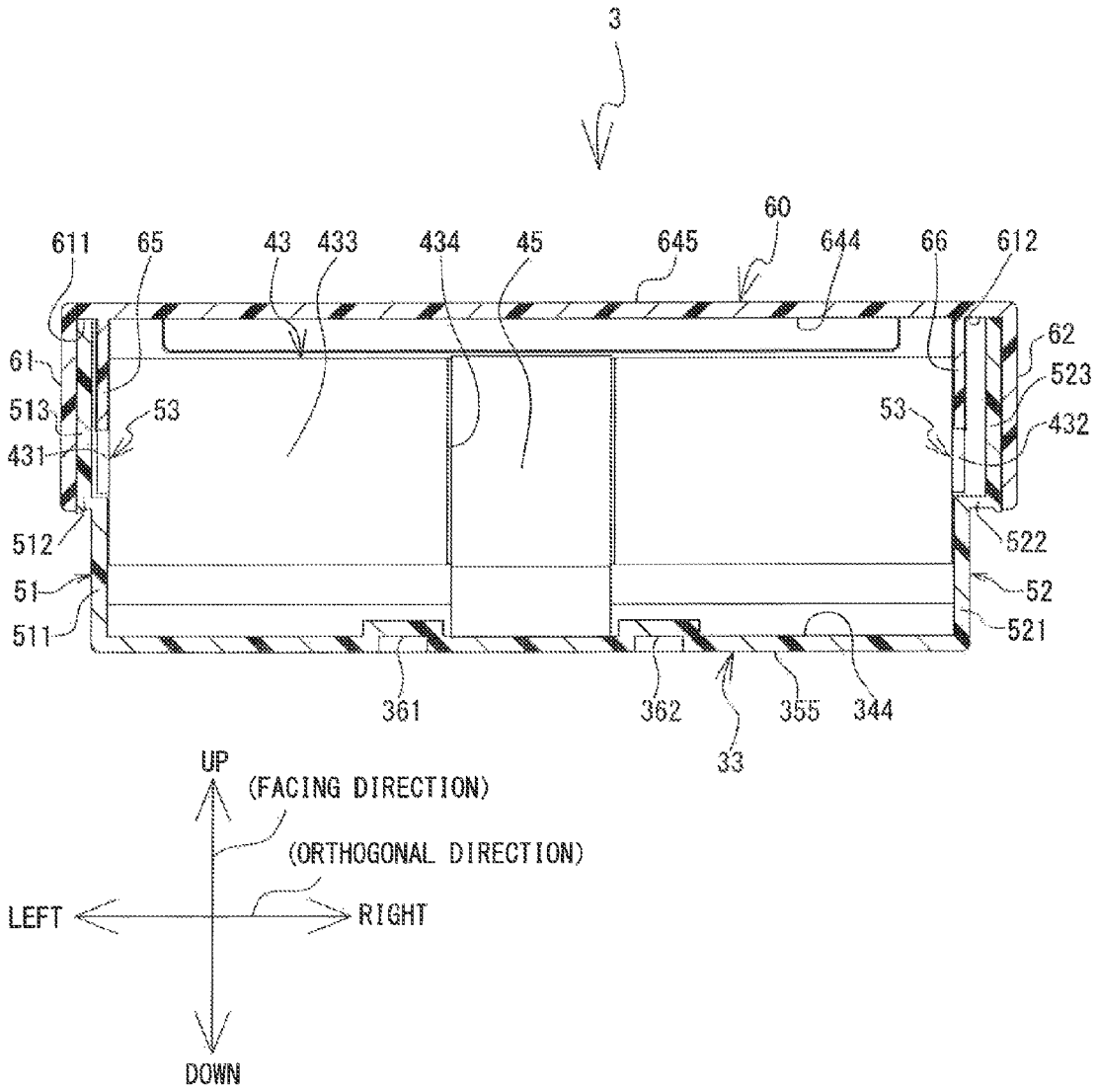
FIG. 11 is a cross-sectional view along a line A-A shown in FIG. 3.

The pair of side walls 51 and 52 will be explained in detail. An illustration of the liquid storage bag 13 is omitted from FIG. 11. As shown in FIG. 8 and FIG. 11, the left side wall 51 is provided with a first portion 511, a second portion 512 and a third portion 513. The right side wall 52 is provided with a first portion 521, a second portion 522 and a third portion 523. The first portions 511 and 521 are wall portions that extend upward from each of the lower end portions of the side walls 51 and 52. The first portions 511 and 521 protrude upward from each of end portions of the first inner surface 344 in the orthogonal direction. The first portions 511 and 521 are provided from each of end portions in the second direction of the first case 33 and extended along the first direction. The protruding end portions 431 and 432 are clamped and supported by upper ends of the first portions 511 and 512 and lower ends of the protruding wall portions 65 and 66 of the second case 60 (refer to FIG. 11).

The second portions 512 and 522 protrude outward of the case 3 in the orthogonal direction from the upper ends of the first portions 511 and 521. The third portions 513 and 523 extend upward from the end portions of the second portions 512 and 522.

The shaft portion 43 will be explained. As shown in FIG. 8 and FIG. 11, the shaft portion 43 is a circular column and extends in the orthogonal direction. An outer peripheral surface 433 of the shaft portion 43 is smooth in the peripheral direction. The shaft portion 43 is provided with the protruding end portions 431 and 432, and a shaft recessed portion 434. The protruding end portions 431 and 432 protrude, respectively, in the orthogonal direction from the pair of end portions of the shaft portion 43 in the orthogonal direction. The shaft recessed portion 434 is a recessed portion that is recessed toward the center axis of the shaft portion 43, in the outer peripheral surface 433 of the shaft portion 43. The shaft recessed portion 434 is provided in a center portion, in the orthogonal direction, of the shaft portion 43. The shaft recessed portion 434 takes up the end portion on the second direction side of the elastic member 45.

As shown in FIG. 11, the protruding end portions 431 and 432 are positioned between the first portions 511 and 521 of the first case 33 and the protruding wall portions 65 and 66 (to be explained later) of the second case 60. When the shaft portion 43 moves as a result of the urging force of the elastic member 45, the protruding end portions 431 and 432 move along movement paths 53 (refer to FIG. 11 and FIG. 15A), which extend in the front-rear direction and which are formed by the first portions 511 and 521 and the protruding wall portions 65 and 66.

The shaft portion 43 advances in the first direction while taking up the liquid storage bag 13 and thus gathering the ink toward the plug 7. The further the shaft portion 43 is positioned in the first direction, the smaller a remaining amount of ink inside the liquid storage portion 133. Thus, if the position of the shaft portion 43 in the first direction is displayed, it is possible to display the remaining amount of ink inside the liquid storage portion 133. The case 32 has a detection portion (not shown in the drawings) for displaying the remaining amount of ink.

The second case 60 will be explained. As shown in FIG. 8 and FIG. 11 to FIG. 13, the second case 60 is provided with an upper wall portion 64, a pair of side walls 61 and 62, the protruding wall portions 65 and 66 (refer to FIG. 11), groove portions 611 and 612 (refer to FIG. 11) and pressing wall portions 67 and 68 (refer to FIG. 12). The upper wall portion 64 extends in the first direction from the rear end portion of the second case 60. The upper wall portion 64 is provided with a second inner surface 644, which is the bottom surface of the upper wall portion 64, and a second outer surface 645, which is on the opposite side of the second inner surface 644. As shown in FIG. 8, the first inner surface 344 of the first case 33 and the second inner surface 644 of the second case 60 face each other in the facing direction. The end portion on the second direction side of the second outer surface 645 has an outer surface recessed portion 641, which is recessed downward. The outer surface recessed portion 641 has a rectangular shape that is long in the orthogonal direction in a plan view. When the operator slides the second case 60 with respect to the first case 33, the operator moves the second case 60 by placing his/her finger in the outer surface recessed portion 641, for example.

Figure 12:
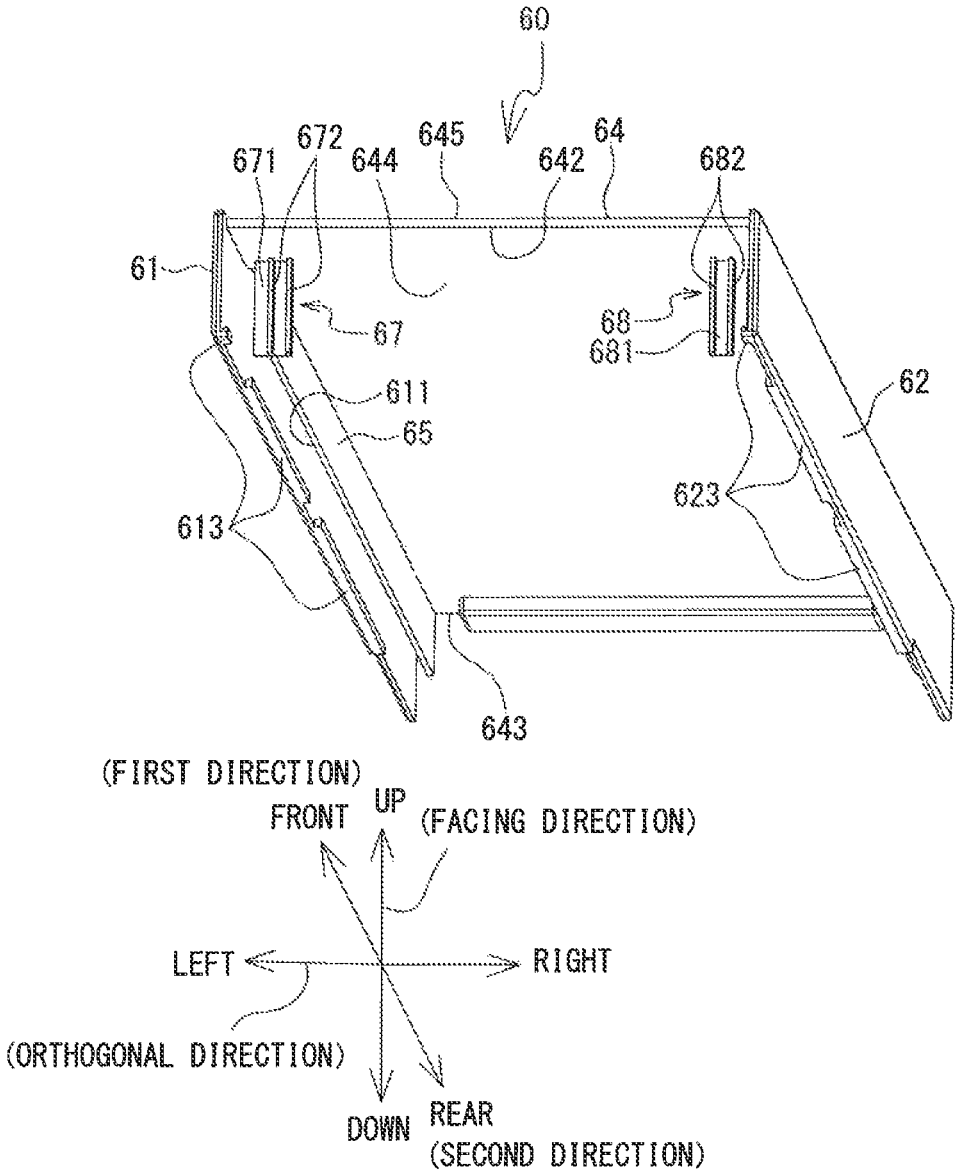
FIG. 12 is a perspective view of a second case.
Figure 13:
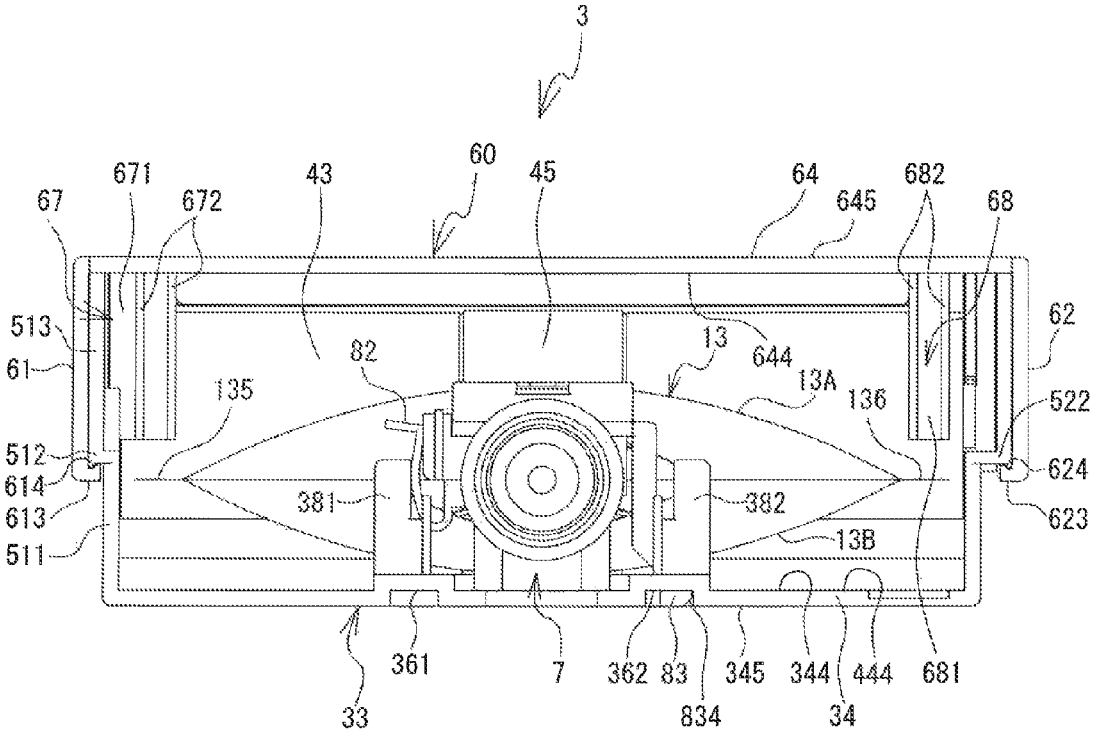
FIG. 13 is a front view of the cartridge.
Figure 13:
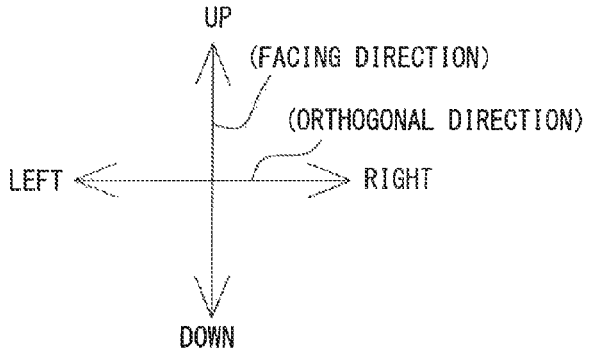
Figure 14:
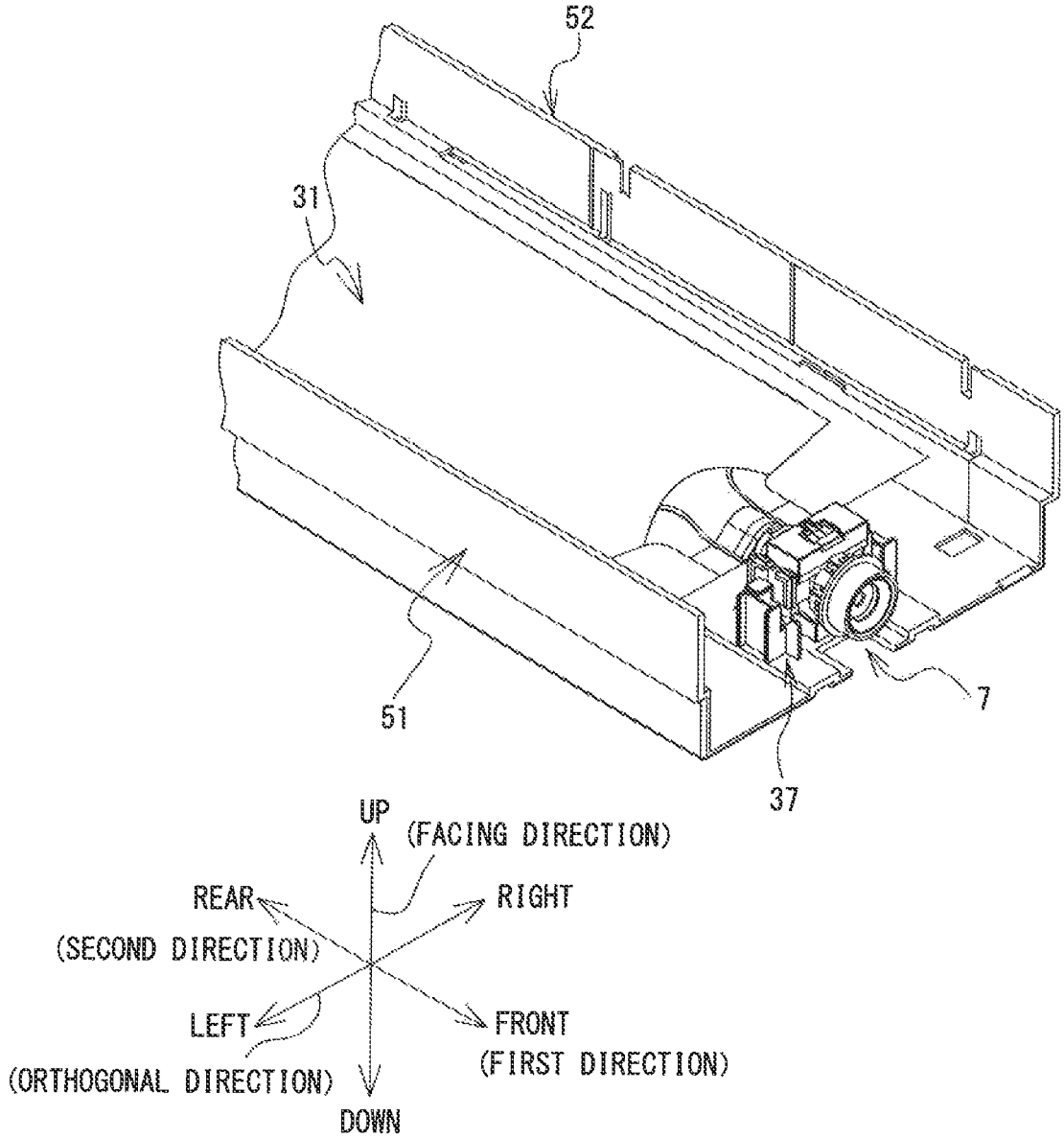
FIG. 14 is a perspective view of the front end portion of the first case.

The pair of side walls 61 and 62 respectively extend downward from the end portions in the orthogonal direction of the second inner surface 644. As shown in FIG. 12 and FIG. 13, each of the lower end portions of the pair of side walls 61 and 62 are provided with a plurality of leading end wall portions 613 and 623. The leading end wall portions 613 and 623 respectively protrude from the side walls 61 and 62 toward the inside in the orthogonal direction.

As shown in FIG. 13, when the second case 60 is mounted on the first case 33, the pair of side walls 61 and 62 of the second case 60 are positioned on the outside of the pair of side walls 51 and 52 of the first case 33. Namely, the first case 33 is an inner case and the second case 60 is an outer case. The second portions 512 and 522 of the side walls 51 and 52 face upper surfaces 614 and 624, which are surfaces of the leading end wall portions 613 and 623 on the side of the second inner surface 644. As a result, the second portions 512 and 522 and the leading end wall portions 613 and 623 engage with each other.

As shown in FIG. 12, the end portion on the first direction side of the second case 60 is provided with an open portion 642, which opens in the front-rear direction. The end portion on the second direction side of the second case 60 is provided with an open portion 643, which opens in the front-rear direction.

As shown in FIG. 11, the protruding wall portions 65 and 66 are wall portions that are provided facing the side walls 61 and 62, respectively, on the inside of the side walls 61 and 62 in the orthogonal direction. The protruding wall portions 65 and 66 extend from the second inner surface 644 toward the first inner surface 344 (refer to FIG. 12) between the end portion on the second direction side of the second case 60 and a position which is near to the end portion on the first direction side of the second case 60. The groove portion 611 is a groove that is recessed upward and that is formed between the protruding wall portion 65 and the side wall 61. The groove portion 612 is a groove that is recessed upward and that is formed between the protruding wall portion 66 and the side wall 62. The third portions 513 and 523 of the pair of side walls 51 and 52 of the first case 33 are positioned inside the groove portions 611 and 612, respectively.

As shown in FIG. 12, the pressing wall portions 67 and 68 protrude downward, (namely, to the side of the first inner surface 344), from the end portions in the first direction of the second inner surface 644. The pressing wall portions 67 and 68 are positioned further to the first direction side than the shaft portion 43 when the shaft portion 43 is positioned in a second position that will be explained later (refer to FIG. 15A). As shown in FIG. 13, the pressing wall portions 67 and 68 are provided on the end portions in the orthogonal direction of the second case 60. The elastic member 45 are positioned between the pressing wall portions 67 and 68. As shown in FIG. 12 and FIG. 13, the pressing wall portion 67 is provided with a first wall portion 671 and two second wall portions 672. The pressing wall portion 68 is provided with a first wall portion 681 and two second wall portions 682. Each of the first wall portions 671 and 681 is a wall portion that faces the shaft portion 43 and that has a flat surface that is parallel to the orthogonal direction. The two second wall portions 672 protrude in the first direction from the center portion and the right end portion in the orthogonal direction of the first wall portion 671. The two second wall portions 682 protrude in the first direction from the end portions in the orthogonal direction of the first wall portion 681.

Figure 15A:
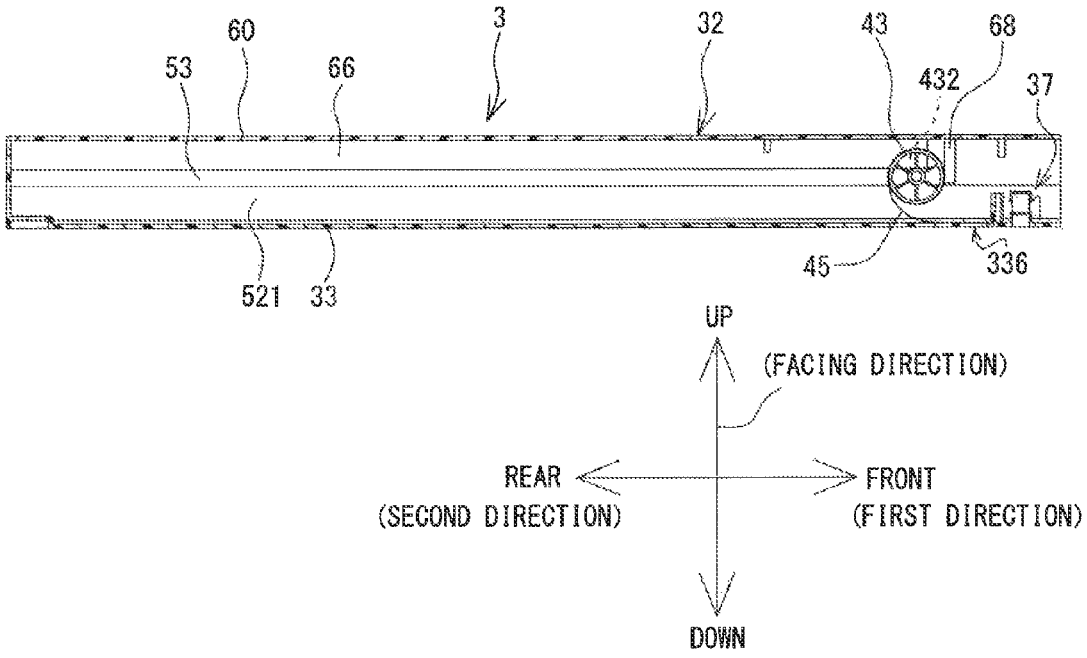
FIG. 15A is a cross-sectional view along a line B-B shown in FIG. 3.
Figure 15B:
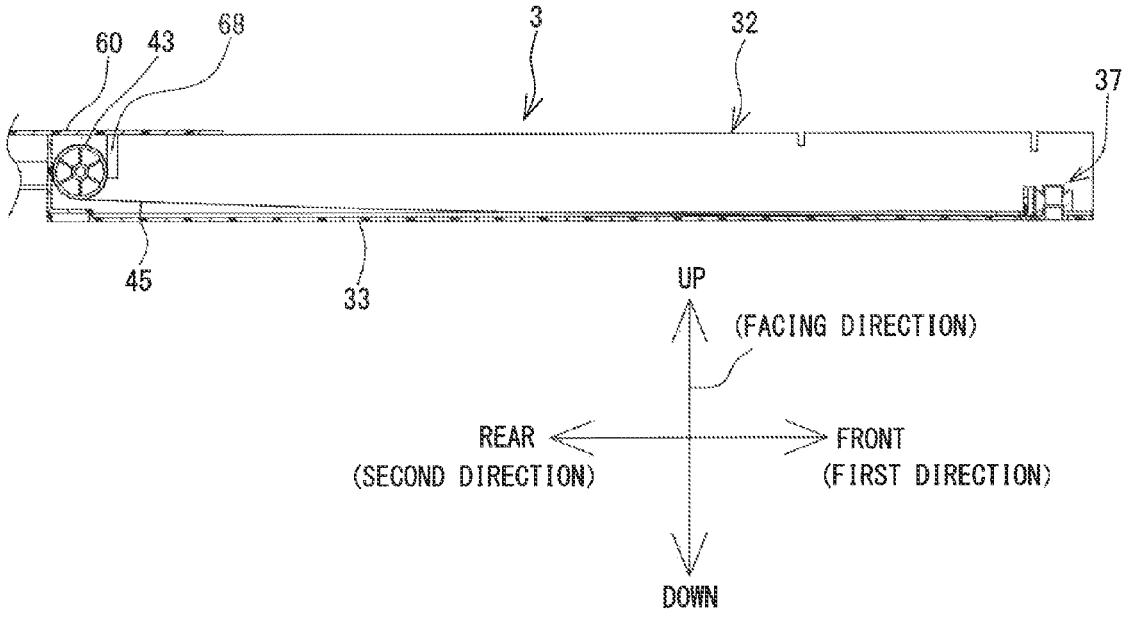
FIG. 15B is a cross-sectional view and is a continuation of FIG. 15A.

An operation will be explained in which the operator assembles the case 32, mounts the liquid storage body 31 in the case 32 and mounts the case 32 in the cartridge mounting portion 8. For example, when the cartridge 3 is manufactured in a manufacturing factory of the cartridge 3, or when the cartridge 3 is used in a factory or a household that uses the printer 1, the operator performs the operation to assemble the case 32 and mount the liquid storage body 31 in the case 32. For example, in the factory or such place that uses the printer 1, at a time of replacing the liquid storage body 31 inside the cartridge 3, the operator first removes the used liquid storage body 31 from the case 32 and then mounts the new liquid storage body 31 in the case 32. In the following explanation, of a movable range of the shaft portion 43, a position furthest to the second direction side as shown in FIG. 15B is referred to as a first position. Of the movable range on the first direction side from the first position, a position that is furthest to the first direction side as shown in FIG. 15A is referred to as the second position. FIG. 15A to FIG. 15D, and FIG. 16A to FIG. 16D are simplified diagrams, and an illustration of the detection portion 46 etc. is omitted. In FIG. 15A to FIG. 15D and FIG. 16A to FIG. 16D, of the pressing wall portions 67 and 68, only the pressing wall portion 68 is shown. In FIG. 15A to FIG. 15D and FIG. 16A to FIG. 16D, the movement paths 53 are only shown in FIG. 15A.

As shown in FIG. 8, at the time of assembly of the case 32, the operator arranges the elastic member 45 in the case recessed portion 335 of the first case 33. The operator arranges the end portion on the first direction side of the elastic member 45 on the mounting portion 336, and takes up the end portion on the second direction side of the elastic member 45 onto the shaft recessed portion 434 of the shaft portion 43. The operator places the protruding end portions 431 and 432 of the shaft portion 43 on the upper side of the first portions 511 and 521, and arranges the shaft portion 43 in the first case 33. The operator arranges the second case 60 on top of the first case 33 while sliding the second case 60 in the second direction from the first direction side of the first case 33. At this time, the protruding end portions 431 and 432 of the shaft portion 43 are positioned between the first portions 511 and 521 of the first case 33 and the protruding wall portions 65 and 66 (refer to FIG. 11). The second case 60 slides in the second direction with respect to the first case 33. The operator arranges the detection portion 46 in the first case 33. The operator assembles the case 32 in the above-described manner. An order of assembly of each structural member is optional and is not limited to the above-described order.

As shown in FIG. 15A, when the liquid storage body 31 is not mounted in the case 32, the shaft portion 43 moves to the second position as a result of the urging force of the elastic member 45. The pressing wall portions 67 and 68 of the second case 60 are positioned on the first direction side of the shaft portion 43. As shown in FIG. 15B, the operator slides the second case 60 in the second direction with respect to the first case 33, and opens the second case 60, which forms a lid of the case 32. With the sliding of the second case 60, the pressing wall portions 67 and 68 push the shaft portion 43 in the second direction and the shaft portion 43 moves to the first position along the movement paths 53. The elastic member 45 is extended according to the movement of the shaft portion 43 toward the first position.

Figure 15C:
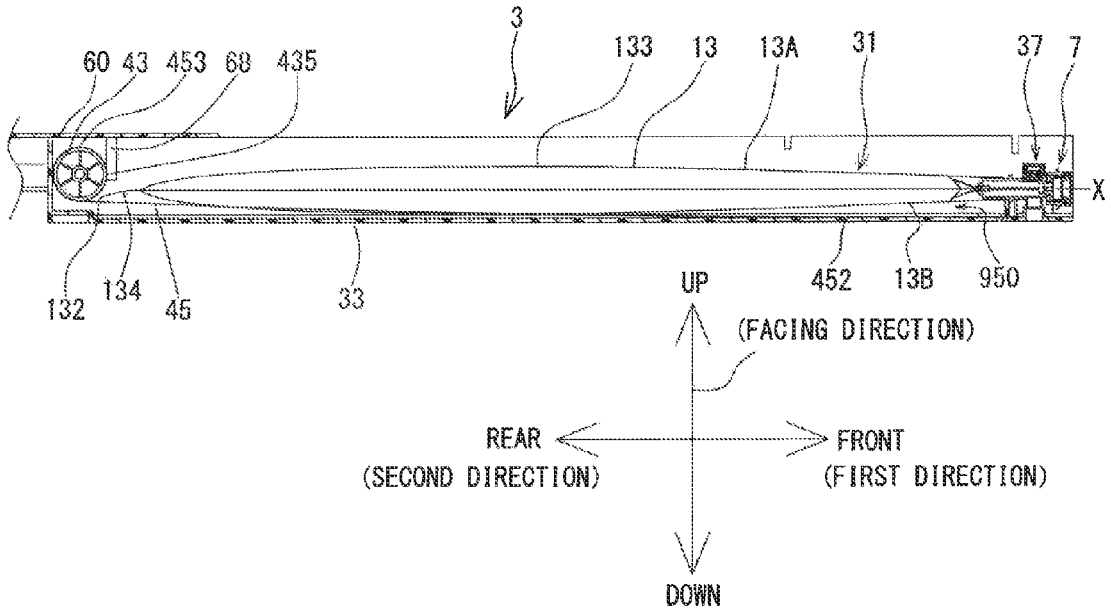
FIG. 15C is a cross-sectional view and is a continuation of FIG. 15B.

The operator grasps the plug 7 of the liquid storage body 31. The second plug protruding portion 85 elastically deforms on the plug 7 side. As shown in FIG. 15C, the operator arranges the liquid storage body 31 in the first case 33 from above the first case 33. At that time, the first plug protruding portion 83 protrudes downward from the first open portion 372. The lower end portion of the first plug protruding portion 83 is positioned inside the groove portion 362 (refer to FIG. 13). The first engagement tab 834 of the first plug protruding portion 83 engages with the groove portion 362 on the first outer surface 345 side. The first support portion 346 and the second support portion 347 support the bottom surface of the plug 7. The second engagement tab 856 of the second plug protruding portion 85 engages with the second open portion 391 (refer to FIG. 9). The second plug protruding portion 85 engages with the second open portion 391 in an elastically deformed state. The plug support portion 37 supports the plug 7 in this way.

As shown in FIG. 15C, in the facing direction, a center position (a position shown on the X-axis line) of the plug 7 supported by the plug support portion 37 is positioned above (on the second inner surface 644 side of) a lower end portion 452 (the first inner surface 344 side) of the elastic member 45 (refer to FIG. 11). In other words, the center position of the plug 7 is positioned between an upper end portion 453 and the lower end portion 452 of the elastic member 45. The upper end portion 453 is the upper end of the elastic member 45 which is taken up on the shaft portion 43. The lower end portion 452 (refer to FIG. 15C) is a portion of the elastic member 45 that is in contact with the first inner surface 344 (refer to FIG. 8). The center position of the plug 7 is the same position as the center of the hollow portion 712 (refer to FIG. 7).

The liquid storage bag 13 is positioned on the upper surface side of the support wall portion 34 and the elastic member 45. The end portion 435 on the first direction side of the shaft portion 43 that is in the first position is positioned further to the first direction side than the second end portion 132 on the second direction side of the liquid storage bag 13.

Figure 15D:
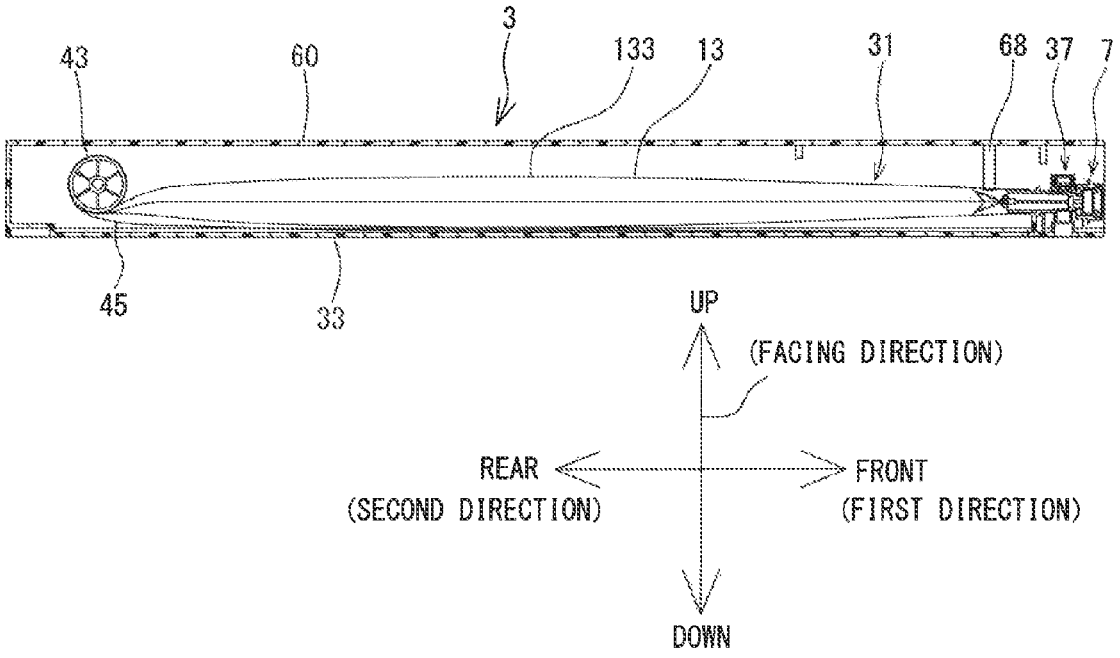
FIG. 15D is a cross-sectional view and is a continuation of FIG. 15C.

As shown in FIG. 15D, the operator moves the second case 60 in the first direction with respect to the second case 33, and closes the second case 60 that forms the lid of the case 32. With the moving of the second case 60 in the first direction, the pressing wall portions 67 and 68 move in the first direction. Pressing from the pressing wall portions 67 and 68 to the shaft portion 43 is released. Therefore, due to the urging force of the elastic member 45, the shaft portion 43 moves in the first direction while rotating in the clockwise direction in a left side view. The elastic member 45 is wound in the clockwise direction in a left side view. The shaft portion 43 takes up the liquid storage bag 13 from the second end portion 132 on the second direction side toward the first direction side. As the extension portion 134 is a flat region in which no ink is stored, the shaft portion 43 easily takes up the extension portion 134. The shaft portion 43 starts taking up the liquid storage portion 133 from the extension portion 134. At the time of taking up of the liquid storage portion 133 by the shaft portion 43, the shaft portion 43 pushes the ink inside the liquid storage portion 133 in the first direction toward the plug 7. The movement of the shaft portion 43 stops at a position at which the force causing the shaft portion 43 to move in the first direction due to the urging force of the elastic member 45 becomes equal to a force with which the liquid storage portion 133 pushes the shaft portion 43 in the second direction. The operator acquires a completed unit of the cartridge 3, in which the new liquid storage body 31 is mounted in the case 32. In the meantime, as shown in FIG. 13, each of the pressing wall portions 67 and 68 is respectively located at the end portion in the orthogonal direction of the second case 60. Therefore, the pressing wall portions 67 and 68 do not interfere with the liquid storage portion 133 when the pressing wall portions 67 and 68 move toward the first direction.

The operator pushes the cartridge 3 into the open portion 120 from the front end side of the cartridge 3, and thus mounts the cartridge 3 in the cartridge mounting portion 8 (refer to FIG. 2). As described above, the hollow needle pierces the rubber plug that is provided in the plug 7 of the liquid storage body 31 stored in the cartridge 3, in order to lead out the liquid from the liquid storage body 31.

Figure 16A:
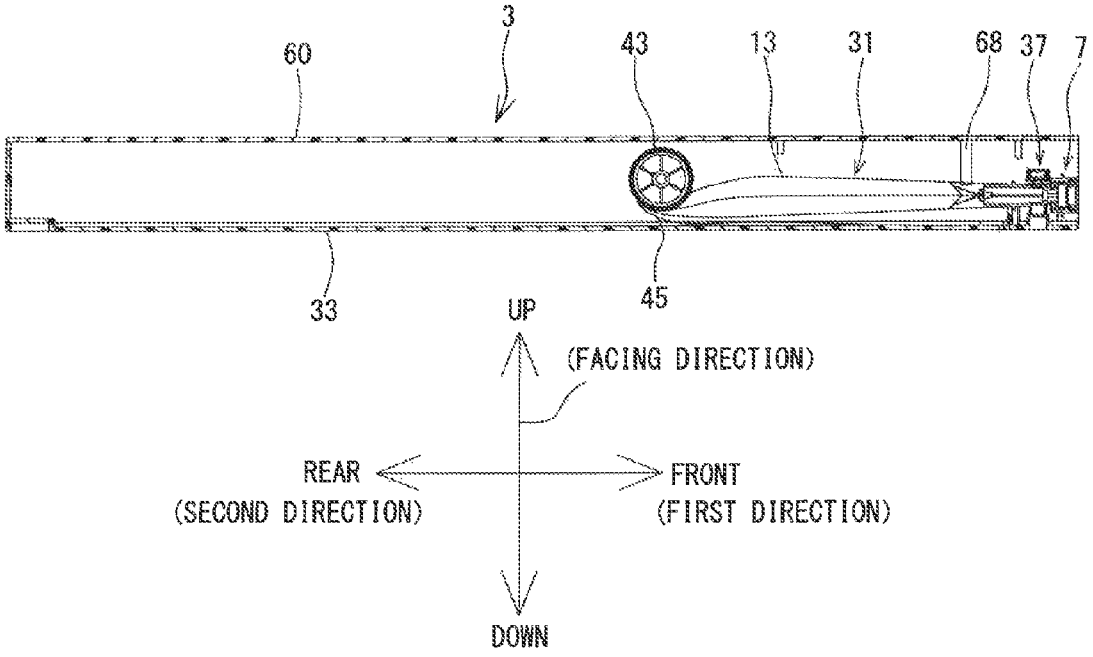
FIG. 16A is a cross-sectional view and is a continuation of FIG. 15D.
Figure 16B:
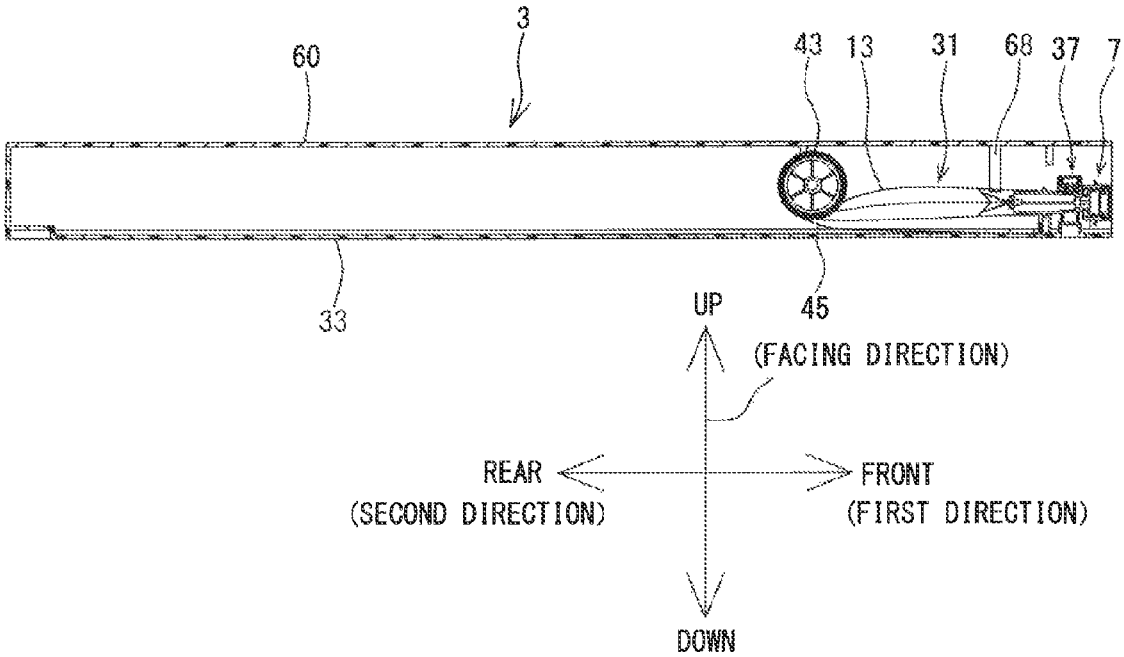
FIG. 16B is a cross-sectional view and is a continuation of FIG. 16A.
Figure 16C:
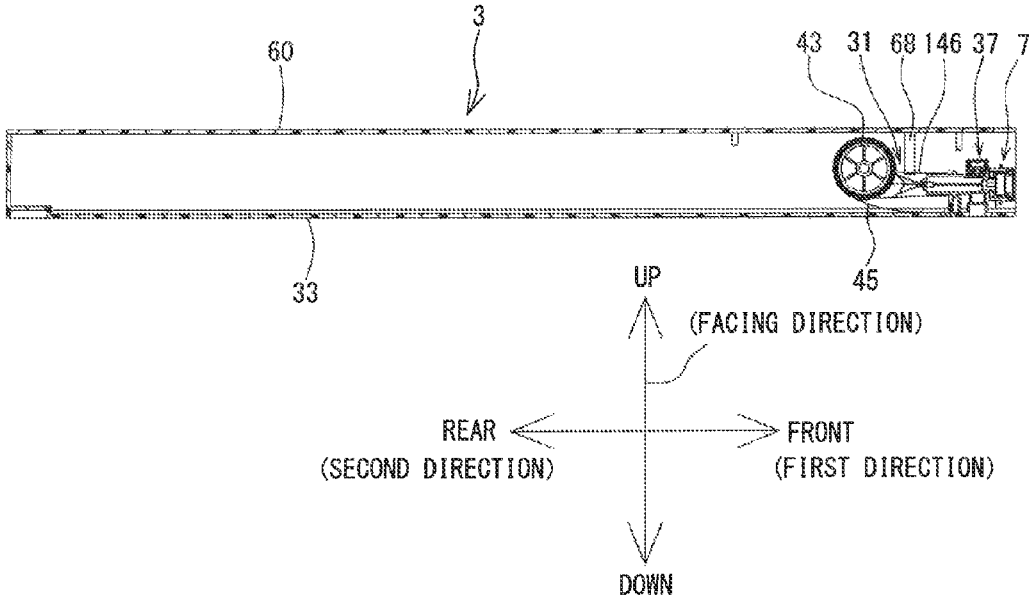
FIG. 16C is a cross-sectional view and is a continuation of FIG. 16B.

At a time of a printing operation, the ink inside the liquid storage portion 133 flows out to the outside of the liquid storage body 31 via the hollow needle. The ink flowing outside of the liquid storage body 31 flows to each of the nozzles. The nozzles of the printer 1 discharge the ink. As shown in FIG. 16A to FIG. 16C, along with the leading out of the ink from the liquid storage body 31, the shaft portion 43 moves in the first direction while taking up the liquid storage portion 133 as a result of the urging force of the elastic member 45.

As shown in FIG. 16C, the shaft portion 43 moves as far as the curved area 146 of the liquid storage bag 13. As described above, in the curved area 146, the sheets 13A and 13B are curved in a direction to separate from each other (in the up-down direction) along the insertion portion 76 (refer to FIG. 5). Thus, it is harder to take up the curved area 146 than a portion further to the second direction side of the curved area 146. Therefore, the movement of the shaft portion 43 stops at the curved area 146. A position at which the shaft portion 43 has stopped is an end position of the movement of the shaft portion 43. The end position of the movement of the shaft portion 43 may be further to the first direction side than the position shown in FIG. 16C.

Figure 16D:
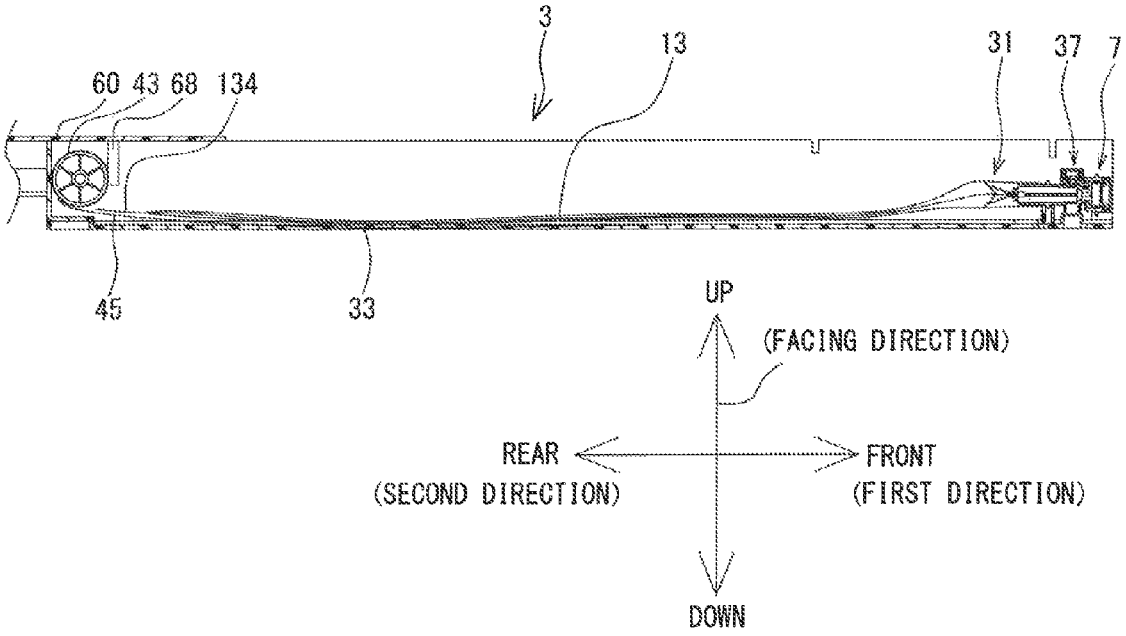
FIG. 16D is a cross-sectional view and is a continuation of FIG. 16C.

The operator removes the cartridge 3 from the cartridge mounting portion 8 and replaces the liquid storage body 31 after the ink has been led out. When the operator moves the second case 60 in the second direction with respect to the first case 33, the pressing wall portions 67 and 68 resist the urging force of the elastic member 45 and move the shaft portion 43, which has taken up the liquid storage bag 13, in the second direction. As a result, as shown in FIG. 16D, the liquid storage bag 13 is apart from the shaft portion 43. The operator removes the liquid storage body 31 after the ink has been led out, and mounts the new liquid storage bag 13 in the case 32, as shown in FIG. 15B and FIG. 15C.

As described above, in the cartridge 3 of the present embodiment, the first case 33 that has the first portions 511 and 521, and the second case 60 that has the protruding wall portions 65 and 66 are separate bodies. Thus, simply by arranging the protruding end portions 431 and 432 of the shaft portion 43 on the first portions 511 and 521 of the first case 33 and then arranging the protruding wall portions 65 and 66 of the second case 60, the shaft portion 43 is arranged inside the case 32 such that the protruding end portions 431 and 432 are sandwiched between the protruding wall portions 65 and 66 and the first portions 511 and 521 (refer to FIG. 11). Thus, the assembly of the case 32 is easy compared to the case of the related art in which the pressure roller holders are arranged at both the end portions of the pressure roller and are inserted into the ratchet guides formed in the hole portions on the inside of the wall portions.

In the structure of the related art in which the pressure roller holders are arranged at both the end portions of the pressure roller, when the size of the hole portions (the ratchet guides) into which the pressure roller is inserted is made larger than a shaft portion of the pressure roller in order to make the assembly easier, there is a risk that the pressure roller may become tilted in the up-down direction, the left-right direction, and/or the front-rear direction. In the present embodiment, the shaft portion 43 is positioned inside the case 32 such that the protruding end portions 431 and 432 are clamped between the protruding wall portions 65 and 66 and the second portions 512 and 522. As a result, in comparison to the case in which the protruding end portions 431 and 432 are arranged in the hole portions having the size being larger than the shaft portion, it is difficult for the shaft portion 43 to become tilted.

The protruding end portions 431 and 432 of the shaft portion 43 are sandwiched between the first portions 511 and 521 and the protruding wall portions 65 and 66 that extend from the second inner surface 644 of the second case 60, which is the outer case, toward the first inner surface 344 of the first case 33, which is the inner case. The side walls 61 and 62 of the second case 60 face to the side walls 51 and 52 of the first case 33. The side walls 51 and 52 of the first case 33 are able to guide the side walls 61 and 62 of the second case 60 when assembling the first case 33 and the second case 60. As a result, the assembly of the case 32 is easy.

The open portion 642 (refer to FIG. 12) is provided to open at least one of the end portion on the first direction side and the end portion on the second direction side of the second case 60. As a result, the second case 60 can slide in the first and second direction with respect to the first case 33. The side walls 51 and 52 of the first case 33 are in the groove portions 611 and 612 of the second case 60. As a result, when the second case 60 and the first case 33 are caused to slide with respect to each other, the groove portions 611 and 612 guide the side walls 51 and 52 of the first case 33. Thus, the second case 60 and the first case 33 slide smoothly. The case 32 can therefore be easily assembled while sliding the second case 60, which is the outer case, with respect to the first case 33, which is the inner case.

As shown in FIG. 8, the elastic member 45 is positioned on the inside of the case recessed portion 335. As a result, in comparison to a case in which the case recessed portion 335 is not provided, it is difficult for the elastic member 45 to become displaced in the orthogonal direction. The elastic member 45, that is hardly to be displaced in the orthogonal direction, urges the shaft portion 43. Thus, it is difficult for the shaft portion 43 to become tilted in the left-right and/or front-rear direction. The case 32 is therefore easy to assemble. The shaft portion 43 can take up the liquid storage bag 13 in a favorable manner.

The elastic member 45 can exert the urging force when the elastic member 45 is further to the second direction side than the mounting portion 336. When the mounting portion 336 is positioned further to the first direction side than the plug support portion 37, it is possible that the shaft portion 43 may move as far as the plug support portion 37 and ride up over the plug support portion 37. However, in the present embodiment, the mounting portion 336 is positioned further to the second direction side than the plug support portion 37 (refer to FIG. 10). Thus, the case 32 is more easily assembled than in a case in which the mounting portion 336 is positioned further to the first direction side than the plug support portion 37. It is thus possible to reduce the possibility of the shaft portion 43 riding up over the plug support portion 37 or the plug 7 and causing the second case 60 to lift upward.

As shown in FIG. 15C, in the present embodiment, the center position (the position shown on the X-axis line) of the plug 7 in the facing direction (the up-down direction) is positioned above (on the second inner surface 644 side of) the lower end portion 452 (the first inner surface 344 side of the first case 33) of the elastic member 45. In this case, an area 950 is generated where the end portion on the first direction side of the lower side sheet 13B of the liquid storage bag 13 is separated from the elastic member 45. When the center position in the facing direction of the plug 7 is the same position as the lower end portion 452 of the elastic member 45, the area 950 is not generated. In case that the space of the area 950 is not generated, the liquid storage bag 13 is easily to become warped or bent when the shaft portion 43 takes up the liquid storage bag 13. Thus, in comparison to the above-described case in which the area 950 is not generated, in the present embodiment, it is difficult for the sheet 13B of the liquid storage bag 13 to become warped or bent. As a result, it is possible to reduce the possibility of it becoming difficult for the shaft portion 43 to move due to the warping or bending of the sheet 13B.

If an outer peripheral surface of the shaft portion 43 is uneven in the peripheral direction, it is possible that the liquid storage bag 13 may become bent when the shaft portion 43 takes up the liquid storage bag 13, and that a diameter may become large after taking up the liquid storage bag 13. In this case, it is possible that the taken up liquid storage bag 13 may become stuck between the first inner surface 344 and the second inner surface 644 and it may become difficult for the shaft portion 43 to move. In the present embodiment, the shaft portion 43 is the circular column whose outer peripheral surface 433 is smooth in the peripheral direction. Thus, the shaft portion 43 can surely take up the liquid storage bag 13.

The elastic member 45 urges the shaft portion 43. If the elastic member 45 is displaced in the orthogonal direction with respect to the shaft portion 43, the shaft portion 43 may become tilted in the left-right and/or front-rear direction. If the shaft portion 43 tilts during the assembly of the case 32, it becomes difficult to assemble the case 32. If the shaft portion 43 tilts and it becomes difficult for the shaft portion 43 to move, it is possible that the liquid storage bag 13 cannot be taken up. In the present embodiment, the shaft recessed portion 434 takes up the end portion on the second direction side of the elastic member 45. Thus, in comparison to a case in which the shaft recessed portion 434 is not provided, it is difficult for the elastic member 45 to become displaced with respect to the shaft portion 43 in the orthogonal direction. As a result, it is difficult for the shaft portion 43 to become tilted. Thus, it is easy to assemble the case 32. It is possible to reduce the possibility that the shaft portion 43 may become tilted and the liquid storage bag 13 cannot be taken up.

When the liquid storage bag 13 is taken up by the urging force of the elastic member 45, it is possible that indented portions 961, as shown by dotted lines in FIG. 5, may occur. The indented portions 961 are portions in which the end portions in the orthogonal direction of the liquid storage bag 13 become indented toward the inside. A magnitude (a length in the orthogonal direction) of the indentation of the indented portions 961 tends to be proportional to a thickness in the facing direction (the left-right direction) of the liquid storage bag 13 and to a force F by which the shaft portion 43 presses the liquid storage bag 13 in the first direction. When the elastic member 45 is a constant load spring, the force F is constant. It is thus possible that the indentation will become larger at the center portion in the front-rear direction of the liquid storage bag 13 at which the thickness in the facing direction (refer to a thickness L4 shown in FIG. 6) is larger than the thickness in the facing direction at the end portion (refer to a thickness L5 in FIG. 6) on the front side of the liquid storage bag 13. In case that the indentation becomes larger, the wound diameter of the liquid storage bag 13 wound by the shaft portion 43 becomes larger. Then, in this case, the shaft portion 43 may be stuck between the first inner surface 344 and the second inner surface 644 and may be difficult to move. In the present embodiment, the elastic member 45 is a variable load spring. Therefore, by causing the force F when the center portion in the front-rear direction of the liquid storage bag 13 is being taken up to be smaller than the force F when the end portion on the front side of the liquid storage bag 13 is being taken up, it is possible to reduce the possibility of the indentation becoming larger and the shaft portion becoming hard to move.

As shown in FIG. 15C, the end portion 435 on the first direction side of the shaft portion 43 is positioned further to the first direction side than the second end portion 132 on the second direction side of the liquid storage bag 13. As a result, the second end portion 132 is sandwiched between the shaft portion 43 and the elastic member 45 in the up-down direction. Then, compared to a case in which the end portion 435 on the first direction side of the shaft portion 43 is positioned further to the second direction side than the second end portion 132 on the second direction side of the liquid storage bag 13, it is possible to more reliably take up the liquid storage bag 13 on the shaft portion 43. Thus, the cartridge 3 using the case 32 can be easily assembled.

In the present embodiment, in concert with the operator performing the operation of sliding the second case 60 with respect to the first case 33, the shaft portion 43 is caused to move in the second direction while the pressing wall portions 67 and 68 resist the urging force of the elastic member 45 (refer to FIG. 15B). As a result, the elastic member 45 that is taken up on the shaft portion 43 is extended. The operator can house the liquid storage body 31 inside the case 32 in the state in which the elastic member 45 is extended (refer to FIG. 15C). Thus, in comparison to a case in which the elastic member 45 is extended manually after the second case 60 has been moved with respect to the first case 33 and the liquid storage body 31 is mounted, it is possible to easily mount the liquid storage body 31 in the case 32.

After the second case 60 has been moved in the second direction with respect to the first case 33, if the operator then removes his/her hand from the second case 60, due to the urging force of the elastic member 45, it is possible that the shaft portion 43 may press the pressing wall portions 67 and 68 in the first direction, and the second case 60 may move in the first direction. In the present embodiment, the groove portions 611 and 612 accommodate the side walls 51 and 52 of the first case 33. As a result, when the second case 60 moves in the first direction due to the urging force of the elastic member 45, friction occurs between the groove portions 611 and 612 and the side walls 51 and 52, and it is possible to restrict a speed of the movement of the second case 60 in the first direction. Thus, the operation in which the operator mounts the liquid storage body 31 in the case 32 becomes easier. By the leading end wall portions 613 and 623 respectively engaging with the second portions 512 and 522, a possibility is reduced that the first case 33 and the second case 60 may become separated from each other. Thus, the operation in which the operator mounts the liquid storage body 31 in the case 32 becomes easier. By providing the outer surface recessed portion 641, the operator can place his/her hand on the outer surface recessed portion 641 and slide the second case 60 with respect to the first case 33. Thus, in comparison to a case in which the outer surface recessed portion 641 is not provided, the operator can easily perform the operation to mount the liquid storage body 31 in the case 32.

The present disclosure is not limited to the above-described embodiment and various modification can be made to the above-described embodiment. For example, the elastic member 45 may be a constant load spring. The end portion 435 on the first direction side of the shaft portion 43 shown in FIG. 15C may be positioned further to the second direction side than the second end portion 132 on the second direction side of the liquid storage bag 13. The shaft recessed portion 434 of the shaft portion 43 need not necessarily be provided.

The shaft portion 43 need not necessarily be the circular column whose outer peripheral surface 433 is smooth in the peripheral direction, and the outer peripheral surface 433 may be uneven in the peripheral direction, for example. The shaft portion 43 need not necessarily be the circular column and may be a prism, for example. The center position of the plug 7 in the facing direction need not necessarily be positioned above (on the second inner surface 644 side of) the lower end portion 452 (the first inner surface 344 side) of the elastic member 45. The bottom end of the liquid storage bag 13 may contact to the elastic member 45 and then the area 950 may not be provided. The case recessed portion 335 need not necessarily be provided. For example, the elastic member 45 may be arranged on a flat surface that is formed on the first inner surface 344.

The present disclosure is not limited to the structure in which the upper side second case 60 is the outer case and the lower side first case 33 is the inner case. For example, the lower side first case 33 may be the outer case and the pair of side walls 51 and 52 may be arranged on the outside of the pair of side walls 61 and 62 of the upper side second case 60. In this case, the first case 33 that is the outer case may be provided with protruding wall portions that extend from the first inner surface 344 toward the second inner surface 644, in a similar manner to the protruding wall portions 65 and 66 of the above-described embodiment. The second case 60 that is the inner case may be provided with portions corresponding to the first portions 511 and 521 of the above-described embodiment. The protruding end portions 431 and 432 may be sandwiched between the protruding wall portions of the first case 33 that is the outer case and the portions of the second case 60 (that is the inner case) corresponding to the first portions 511 and 521. Alternatively, the second case may be slidable in the front-rear direction by a configuration that the either end of the second face 644 engages a groove provided at the upper end and inside of each of the side walls 51 and 52 of the first case 33, although the second case may not have the side walls 61 and 62. In this case, the protruding end portions 431 and 432 are sandwiched between the protruding wall portions 65 and 66 and the first portions 511 and 521.

In the first case 33, a shape of portions that clamp the protruding end portions 431 and 432 is not particularly limited. Specifically, for example, protruding portions may be provided, across the first direction, on the end portions in the orthogonal direction of the first case 33. The protruding portions may be portions that protrude upward from the first inner surface 344, or may be portions that protrude from the side walls 51 and 52 toward the inside in the orthogonal direction. In the second case 60, a shape of portions that sandwich the protruding end portions 431 and 432 is not particularly limited. Specifically, protruding portions may be provided, across the first direction, on the end portions in the orthogonal direction of the second case 60. The protruding portions may be, for example, portions that protrude from the side walls 61 and 62 toward the inside in the orthogonal direction.

The outer surface recessed portion 641 need not necessarily be provided. As long as the second case 60 is capable of sliding with respect to the first case 33, a detailed structure is not particularly limited. Specifically, for example, it is not essential to provide the structure in which the leading end wall portions 613 and 623 and the second portions 512 and 522 engage with each other. The protruding wall portions 65 and 66 need not necessarily be provided. The groove portions 611 and 612 need not necessarily be provided. In these cases also, the second case 60 is able to slide with respect to the first case 33.

Figure 17:
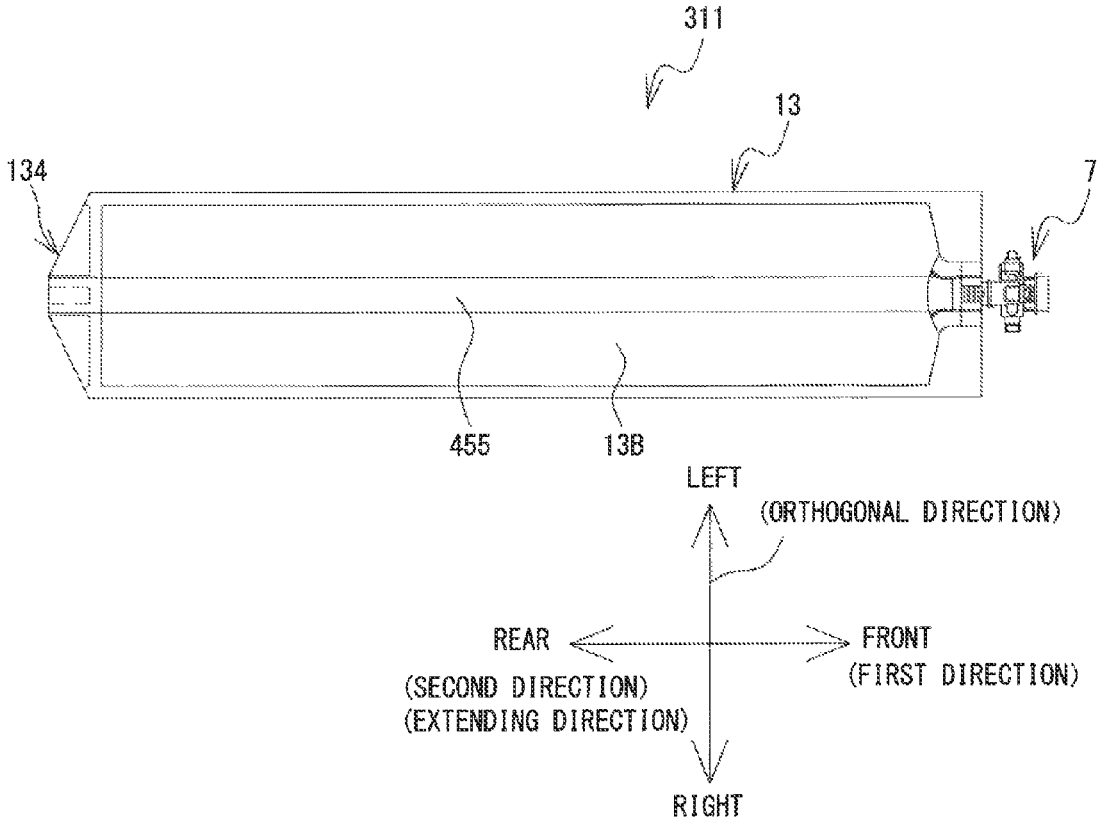
FIG. 17 is a bottom view of a liquid storage body of a modified example.

The structure in which the elastic member 45 is provided inside the case 32 is not essential. For example, as shown in FIG. 17, an elastic member 455 may be adhered to a center portion in the orthogonal direction of the sheet 13B on the bottom surface side of the liquid storage bag 13. The elastic member 455 extends in the second direction (the extending direction) from the second direction side of the plug 7 that is provided on the end portion on the first direction side. The end portion on the second direction side of the elastic member 455 is positioned in the extension portion 134. When a liquid storage body 311 is used, the mounting portion 336 (refer to FIG. 10) and the elastic member 45 (refer to FIG. 8) need not necessarily be provided in the first case 33. By placing the liquid storage body 311 in the case 32 that is not provided with the elastic member 45, and winding the end portion on the second direction side of the elastic member 455 around the shaft portion 43 along with the extension portion 134, it is possible to take up the liquid storage bag 13 in a similar manner to the cases shown in FIG. 15A to FIG. 15D and FIG. 16A to FIG. 16D and then to push liquid in the liquid storage portion 133 out to the plug 7.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cartridge case configured to support a liquid storage body having a bag that stores a liquid, the cartridge case comprising:

a first case having a first surface at a bottom thereof, the first surface being capable of placing the bag thereon, the first case extending in a first direction parallel to the first surface;

a second case extending in the first direction and having a second surface facing the first surface;

a shaft portion configured to move in the first direction with taking up the bag due to a restoring force of an elastic member by taking up an end portion on a second direction side of the elastic member, the elastic member being configured to generate the restoring force in the first direction by extending in the second direction opposite to the first direction, the shaft portion extending in a third direction that is a direction parallel to the first and the second surfaces and orthogonal to the first direction;

first protruding portions that are protruding portions provided on end portions in the third direction of the first case, each of the first protruding portions being formed extending across the first direction in a manner of protruding from each of the end portions in the third direction of the first case;

second protruding portions that are protruding portions provided on end portions in the third direction of the second case and formed extending across the first direction, each of the second protruding portions protruding from each of the end portions in the third direction of the second case toward the first surface in a manner of facing one of the first protruding portions; and protruding end portions that protrude in the third direction from each of a pair of end portions in the third direction of the shaft portion, the protruding end portions being guided by the first protruding portions and the second protruding portions.

2. The cartridge case according to claim 1, wherein each of the first case and the second case includes a pair of side walls on end portions in the third direction, one of the first case and the second case is an outer case which is arranged on outside of another, the another of the first case and the second case is an inner case, and the pair of side walls of the outer case are arranged on outside of the pair of the side walls of the inner case, in a manner of facing the pair of the side walls of the inner case.

3. The cartridge case according to claim 2, further comprising an open portion formed to open at least one of an end portion of the outer case on a first direction side and an end portion of the outer case on the second direction side, wherein the second protruding portions are provided on the outer case, each of the second protruding portions extending in a manner of facing each of the side walls of the outer case, a pair of groove portions are provided on the outer case, each of the pair of the groove portions being formed between each of the second protruding portions and each of the side walls located proximate to the second protruding portions, a width of the groove portion in the third direction being wider than the side wall of the inner case in a manner of accommodating the side wall of the inner case inside of the groove portion.

4. The cartridge case according to claim 1, wherein the first surface of the first case includes a case recessed portion extending in the second direction, the case recessed portion being a recessed portion having a longer width than a width in the third direction of the elastic member, and the case recessed portion is possible to arrange the elastic member inside thereof.

5. The cartridge case according to claim 1, wherein the first case includes a plug support portion that supports a plug connected to the bag, and a mounting portion on which is mounted an end portion on a first direction side of the elastic member, and the mounting portion is positioned further to the second direction side than the plug support portion.

6. The cartridge case according to claim 5, wherein the plug support portion is formed on the first surface to support the plug on a side of the second surface.

7. The cartridge case according to claim 1, wherein the shaft portion is a circular column.

8. The cartridge case according to claim 7, wherein the outer peripheral surface of the shaft portion includes a shaft recessed portion that is recessed toward an inside of the shaft portion, and the shaft recessed portion takes up the end portion on the second direction side of the elastic member.

9. The cartridge case according to claim 1, wherein the elastic member is a variable load plate spring having a variable load such that the restoring force of the end portion on the second direction side is smaller than the restoring force of a central portion in the second direction when the elastic member is mounted on the cartridge case and extended in the second direction.

10. The cartridge case according to claim 1, wherein when the shaft portion is in a position that is furthest to the second direction side of a movable range of the shaft portion, an end portion on a first direction side of the shaft portion is positioned further to first direction side than a position of an end portion on the second direction side of the bag.

* * * * *